US009297060B2

(12) United States Patent
Ono et al.

(10) Patent No.: US 9,297,060 B2
(45) **Date of Patent: *Mar. 29, 2016**

(54) HIGH STRENGTH GALVANIZED STEEL SHEET AND METHOD FOR MANUFACTURING THE SAME

(71) Applicant: JFE STEEL CORPORATION, Tokyo (JP)

(72) Inventors: Yoshihiko Ono, Hiroshima (JP); Kenji Takahashi, Hiroshima (JP); Kaneharu Okuda, Chiba (JP); Shoichiro Taira, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/104,451

(22) Filed: Dec. 12, 2013

(65) Prior Publication Data

US 2014/0102597 A1 Apr. 17, 2014

Related U.S. Application Data

(62) Division of application No. 13/147,304, filed as application No. PCT/JP2010/051737 on Feb. 2, 2010, now Pat. No. 8,636,852.

(30) Foreign Application Priority Data

Feb. 2, 2009 (JP) ..... 2009-021334
Jan. 25, 2010 (JP) ..... 2010-013093

(51) Int. Cl.
*C23C 2/40* (2006.01)
*C21D 6/00* (2006.01)

(Continued)

(52) U.S. Cl.
CPC ... *C23C 2/40* (2013.01); *C21D 6/00* (2013.01); *C21D 9/46* (2013.01); *C22C 38/001* (2013.01);

(Continued)

(58) Field of Classification Search
CPC ..... C22C 38/00; C23C 2/40
USPC ..... 148/320, 333, 506, 533, 579, 648, 148/650–654; 420/104; 428/659, 684
See application file for complete search history.

(56) References Cited

U.S. PATENT DOCUMENTS 6,312,536 B1 11/2001 Omiya et al.
8,636,852 B2 1/2014 Ono (Continued)

FOREIGN PATENT DOCUMENTS

JP 55122821 A 9/1980
JP 5623230 3/1981

(Continued)

OTHER PUBLICATIONS

Supplementary European Search Report dated Sep. 10, 2012, application No. EP10735977.

(Continued)

*Primary Examiner* — Brian Walck
(74) *Attorney, Agent, or Firm* — RatnerPrestia

(57) ABSTRACT

The high strength galvanized steel sheet contains C: more than 0.015% and lower than 0.100%, Si: 0.3% or lower, Mn: lower than 1.90%, P: 0.015% or more and 0.05% or lower, S: 0.03% or lower, sol.Al: 0.01% or more and 0.5% or lower, N: 0.005% or lower, Cr: lower than 0.30%, B: 0.0003% or more and 0.005% or lower, and Ti: lower than 0.014% in terms of mass %, and satisfies $2.2 \leq [Mneq] \leq 3.1$ and $0.42 \leq 8[\%P]+150B^* \leq 0.73$. The steel microstructure contains ferrite and a second phase, in which the second phase area ratio is 3 to 15%, the ratio of the area ratio of martensite and retained γ to the second phase area ratio is more than 70%, and 50% or more of the area ratio of the second phase exists in the grain boundary triple point.

3 Claims, 6 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C22C 38/22*** | (2006.01) |
| ***C22C 38/28*** | (2006.01) |
| ***C22C 38/32*** | (2006.01) |
| ***C23C 2/02*** | (2006.01) |
| ***C23C 2/06*** | (2006.01) |
| ***C23C 2/28*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/28* (2013.01); *C22C 38/32* (2013.01); *C23C 2/02* (2013.01); *C23C 2/06* (2013.01); *C23C 2/28* (2013.01); *C21D 2211/005* (2013.01); *C21D 2211/008* (2013.01); *Y10T 428/12799* (2015.01); *Y10T 428/12972* (2015.01)

(56) References Cited

U.S. PATENT DOCUMENTS

| | | | |
|---|---|---|---|
| 2003/0099857 | A1 | 5/2003 | Nomura et al. |
| 2003/0111144 | A1 | 6/2003 | Matsuoka et al. |
| 2008/0075971 | A1 | 3/2008 | Sun |
| 2008/0202638 | A1 | 8/2008 | Haga |
| 2010/0326572 | A1 | 12/2010 | Ono |

FOREIGN PATENT DOCUMENTS

| | | | |
|---|---|---|---|
| JP | 6240405 | B2 | 8/1987 |
| JP | 62182225 | | 8/1987 |
| JP | 03277743 | | 12/1991 |
| JP | 083677 | | 1/1996 |
| JP | 10330903 | A | 12/1998 |
| JP | 2000-212686 | A | 8/2000 |
| JP | 2001-207237 | A | 7/2001 |
| JP | 2001220641 | | 8/2001 |
| JP | 2002-317245 | A | 10/2002 |
| JP | 2003129172 | | 5/2003 |
| JP | 2005-008904 | A | 1/2005 |
| JP | 2005-029867 | A | 2/2005 |
| JP | 2005-220430 | A | 8/2005 |
| JP | 2006052465 | | 2/2006 |
| JP | 2006-233294 | A | 9/2006 |
| JP | 2007211338 | A | 8/2007 |
| JP | 3969350 | | 9/2007 |
| JP | 2008019502 | A | 1/2008 |
| JP | 4113036 | | 7/2008 |
| JP | 2009035816 | | 2/2009 |
| JP | 2010196159 | | 9/2010 |
| WO | WO2007/067014 | A1 | 6/2007 |
| WO | WO2008/082134 | A1 | 7/2008 |
| WO | WO2008/082146 | A1 | 7/2008 |
| WO | WO2009/008551 | A1 | 1/2009 |

OTHER PUBLICATIONS

International Application Serial No. PCT/JP2010/051737, International Search Report mailed May 18, 2010, 2 pgs.

Entire patent prosecution history of U.S. Appl. No. 14/058,580, filed Oct. 21, 2013, entitled, "High Strength Cold Rolled Steel Sheet and Method for Manufacturing the Same."

Entire patent prosecution history of U.S. Appl. No. 12/668,057, filed Jan. 28, 2010, entitled, "Method for Producing Low Yield Strength Cold Rolled Steel Sheet Excellent in Uniformity."

HIGH STRENGTH GALVANIZED STEEL SHEET AND METHOD FOR MANUFACTURING THE SAME

CROSS-REFERENCE TO RELATED APPLICATIONS

This application is a divisional application of U.S. patent application Ser. No. 13/147,304, filed Oct. 12, 2011, which is a U.S. National Phase application of PCT International Application No. PCT/JP2010/051737, filed Feb. 2, 2010, and claims priority to Japanese Patent Application No. 2009-021334, filed Feb. 2, 2009, and Japanese Patent Application No. 2010-013093, filed Jan. 25, 2010, and the disclosures of each of these applications are incorporated herein by reference in their entireties for all purposes.

FIELD OF THE INVENTION

The present invention relates to a high strength galvanized steel sheet for press forming to be used through a press forming process in automobiles, household electrical appliances, and the like and a method for manufacturing the same.

BACKGROUND OF THE INVENTION

Hitherto, BH steel sheets (bake-hardenable steel sheets, hereinafter simply referred to as 340BH) of a TS:340 MPa class has been applied to automobile exposure panels requiring dent resistance, such as hoods, doors, trunk lids, backdoors, or fenders. The 340BH is a ferrite single phase steel in which the amount of solid solution C is controlled by the addition of carbide/nitride formation elements, such as Nb or Ti, in an ultra-low carbon steel containing C: lower than 0.01% (% represents mass %, the same applies hereinafter), and solid solution strengthening is performed by Mn and P. In recent years, a need for reducing the car body weight has further increased. Then, investigations have been made to increase the strength of the exposure panels to which the 340BH has been applied, for a reduction in the thickness of the steel sheet, a reduction in the R/F (Reinforcement: inner reinforcement parts) with the same thickness, a reduction in the temperature and the time in a bake coating process, and the like.

However, when the strength of steel sheet is increased by adding a large amount of Mn and P to a conventional 340BH, the surface distortion of pressed parts remarkably occurs due to an increase in yield stress (YP). Here, the surface distortion refers to minute wrinkles and wave patterns of the press formed surface that are likely to occur in the outer circumferential surface of door knobs and the like. The surface distortion remarkably deteriorates the surface quality of automobiles. Thus, the steel sheets to be applied to the outer panels are required to have a low YP close to that of the current 340BH.

In order to increase the strength after press forming and bake coating while maintaining a low yield stress, the work hardening (WH) during press forming and bake hardening (BH) after press forming need to increase. In particular, in order to stably obtain high dent resistance without depending on the amount of plastic strain given during press forming, it is preferable to increase the BH. However, an increase in the BH causes deterioration of anti-aging properties. In particular, due to the recent globalization of vehicle manufacturing bases, the demand for the steel sheets for panels has been increasing not only in North America or Northeast Asia but in Southeast Asia, South America, India, and the like, and a further increase in the anti-aging properties has been demanded. For example, when the steel sheets are used in regions near the equator, the steel sheets are exposed to 40 to 50° C. for two to five months considering the transportation process or the storage period in warehouses on the regions. Thus, wrinkle-like patterns appears on the surface of pressed panel due to insufficient anti-aging properties in former ferrite single-phase steels. Thus, in recent years, the steel sheets are required to have more excellent anti-aging properties than those of former steel while maintaining a high BH as steel sheet properties.

Furthermore, the steel sheets for automobiles have been required to have excellent corrosion resistance. For example, in parts, such as doors, hoods, and trunk lids, flange portions of the exterior panels are bent by hem processing so as to be joined to the inner. Or, spot welding is performed. At the hem processed portions or the spot welded peripheral portions, the steel sheets are stuck to each other so that a chemical conversion coating is difficult to form during electrodeposition coating, and thus rust is likely to form. In particular, at corner portions in front of hoods or corner portions at door lower portions in which water is likely to collect and which are exposed to a humid atmosphere for a long period of time, holes are frequently formed due to rust. Thus, the steel sheets for exterior panels have been required to have excellent corrosion resistance. In particular, car body manufactures have been examining on an increase in antirust performance of car bodies for extending the hole formation resistance life to 12 years from 10 years (in former cases). Thus, it is indispensable for the steel sheets to have a sufficient corrosion resistance.

In view of such a background, PTL 1, for example, discloses a method for obtaining a galvannealed steel sheet having a low yield stress (YP) and high bake hardening (BH) by optimizing the cooling rate after annealing of a steel containing C: 0.005 to 0.15%, Mn: 0.3 to 2.0%, and Cr: 0.023 to 0.8%, and forming a composite microstructure mainly containing ferrite and a martensite.

PTL 2 discloses a method for obtaining a galvanized steel sheet excellent in both bake hardening properties and room-temperature anti-aging properties by adding 0.02 to 1.5% of Mo to a steel containing C: more than 0.01% and lower than 0.03%, Mn: 0.5 to 2.5%, and B: 0.0025% or lower, and controlling the amount of sol.Al, N, B, and Mn in such a manner as to satisfy sol.Al≥9.7×N, $B \geq 1.5\times10^4\times(Mn^2+1)$ to thereby obtain a microstructure containing ferrite and a low-temperature transformation generation phase.

PTL 3 discloses a method for obtaining a steel sheet excellent in anti-aging properties by cooling a steel sheet containing C: 0.005% or more and lower than 0.04% and Mn: 0.5 to 3.0% to 650° C. or lower at a cooling rate of 70° C./s or more within 2 seconds after the termination of rolling in a hot-rolling process.

PTL 4 discloses a method for obtaining a steel sheet having a low yield ratio, a high BH, and excellent room-temperature anti-aging properties by adjusting Cr/Al to 30 or more in a steel containing C: 0.02 to 0.08%, Mn: 1.0 to 2.5%, P: 0.05% or lower, and Cr: more than 0.2% and 1.5% or lower.

PTL 5 discloses a method for obtaining a galvanized steel sheet having a high YP and a low BH by controlling Mn+1.29Cr to 2.1 to 2.8 in a steel containing C: 0.005 to 0.04%, Mn: 1.0 to 2.0%, and Cr: 0.2 to 1.0% and also adding a relatively large amount of Cr.

PTL 6 discloses a method for obtaining a steel sheet having excellent bake hardening properties by cooling a steel containing C: 0.01% or more and lower than 0.040%, Mn: 0.3 to 1.6%, Cr: 0.5% or lower, and Mo: 0.5% or lower to a temperature of 550 to 750° C. at cooling rate of 3 to 20° C./s after annealing, and then cooling to a temperature of 200° C. or lower at a cooling rate of 100° C. Is or more.

PATENT LITERATURE

PTL 1: Japanese Unexamined Patent Application Publication No. 62-40405

PTL 2: Japanese Unexamined Patent Application Publication No. 2005-8904

PTL 3: Japanese Unexamined Patent Application Publication No. 2005-29867

PTL 4: Japanese Unexamined Patent Application Publication No. 2008-19502

PTL 5: Japanese Unexamined Patent Application Publication No. 2007-211338

PTL 6: Japanese Unexamined Patent Application Publication No. 2006-233294

SUMMARY OF THE INVENTION

However, each of the steel sheets described in PTLs 1 to 5 above is a composite microstructure steel mainly containing ferrite and a martensite as a steel sheet microstructure. The steel having such a microstructure containing a large amount of Mo and Cr that are expensive elements has a sufficiently low YP and a sufficiently high BH compared with former solid solution-strengthened steel sheets. However, a steel containing a small amount of Mo and Cr has been difficult to obtain steel having both a sufficiently low YP and a sufficiently high BH. For example, in former steel, a steel containing 0.2% or more of Mo and 0.30% or more of Cr, such as a steel sheet of a TS: 440 MPa class, can achieve a low YP of about 250 MPa or lower and a high BH about 50 MPa or higher but a steel sheet containing a small amount of Mo and Cr has a high YP or a low BH.

In the former steels described in Patent Literatures above, the anti-aging properties have also not always been sufficient. For example, the steel sheet described in PTL 3 was held at 50° C. for three months supposing the use of the steel sheet in the regions near the equator, and then the presence of the development of the yield point elongation (YPEl) after aging was evaluated but excellent results were not always exhibited. The aging conditions described in PTL 3 are 10 to 15 hr at 100° C. The aging conditions are at most 0.8 to 1.2 months in terms of 50° C. Thus, it is considered that the above evaluation results are obtained due to the fact that the aging conditions were insufficient. Moreover, the method described in PTL 3 requires special rapid cooling after hot rolling. Thus, the method is difficult to apply in a usual rolling line not having special rapid-cooling facilities. Furthermore, as described in PTL 2, many former techniques include adding a large amount (about 0.2%) of Mo in order to increase the anti-aging properties, and the manufacturing cost of such a steel is remarkably high.

The steel sheets described in PTLs 1 to 6 above were examined for the corrosion resistance in a steel sheet shape imitating hem processed portions of hoods or doors. As a result, it was found that many of the steels do not have sufficient corrosion resistance and some of them have corrosion resistance that is remarkably inferior to former steel.

The technique described in PTL 6 requires rapid cooling after annealing, and thus can be applied in a continuous annealing line (CAL) in which plating treatment is not performed but is difficult to apply in a current continuous galvanizing and galvannealing line (CGL) in which plating treatment is performed by immersing in a galvanizing bath held at 450 to 500° C. during cooling after annealing.

The present invention aims at providing a high strength galvanized steel sheet having a low YP, a high BH, excellent anti-aging properties, and excellent corrosion resistance without requiring the addition of a large amount of expensive elements, such as Mo or Cr, or a special CGL heat cycle and a method for manufacturing the same.

The present inventors have conducted extensive researches on a method for simultaneously securing a low YP, a high BH, and excellent anti-aging properties without using expensive elements while increasing the corrosion resistance on former composite microstructure steel sheets having a low yield strength, and have obtained the following conclusions.

(I) The former composite microstructure steel sheets contain a relatively large amount of Cr in order to secure hardenability while maintaining a low strength. However, the corrosion resistance of hem processed portions remarkably deteriorates by the Cr addition. Therefore, in order to secure the corrosion resistance equal to or higher than that of 340BH, the Cr content needs to be reduced to be preferably lower than 0.30%.

(II) In order to maintain a low YP or a low yield ratio (YR) and to secure excellent anti-aging properties, the microstructure is controlled to form a composite microstructure containing ferrite and a second phase which is mainly a martensite by increasing the Mn equivalent and suppressing the generation of pearlite and also 3% or more of the second phase area ratio is preferably secured.

(III) In order to secure a sufficient Mn equivalent while reducing Cr from the viewpoint of securing corrosion resistance, Mn, for example, is preferably utilized. However, when a large amount of Mn is added, ferrite grains elongate to form a non-uniform grain size distribution and also a martensite becomes remarkably fine to cause an increase in the YP. In contrast, B (boron) or P (phosphorous) has a remarkable effect of improving hardenability, and also has an action of uniformly and coarsely polygonizing ferrite grains or an action of uniformly dispersing the second phase in the triple point of the ferrite grain boundary. Specifically, B has a strong action of uniformalizing and coarsening ferrite grains and P has a strong action of uniformly dispersing a martensite. Thus, by composite addition of P and the B in a given range and by suppressing the addition amount of Mn in a given range, uniform and coarse ferrite grains and uniformly dispersed martensite grains are simultaneously obtained and a low YP is obtained also in a steel in which Cr or Mo is reduced.

(IV) The addition of a large amount of Mn causes a reduction in a solid solution C and non-uniform dispersion of the second phase to noticeably deteriorate the BH. In contrast, P and B themselves have an effect of increasing the BH by adding the same. Thus, the BH remarkably increases by adding P and B in the amount equal to or more than a given amount and reducing the addition amount of Mn. Therefore, by controlling P, B, and Mn in specific ranges in addition to the control of the Mn equivalent, a low YP and a high BH are simultaneously obtained.

(V) In the steel of an embodiment of the invention in which the Mn equivalent is increased by utilizing P and B, the ferrite transformation in a cooling process after hot rolling is delayed. Thus, by performing moderate forced cooling and coiling in a given temperature range without performing special rapid cooling, ferrite having a fine hot-rolled microstructure and a fine pearlite or bainite are obtained, and the microstructure after cold rolling and annealing is uniformized and the BH further improves.

Thus, by reducing the proportion of Cr to be lower than 0.30% and performing composite addition of P and B in a given amount and controlling the addition amount of Mn in a given range while increasing the Mn equivalent and, in addition thereto, optimizing the cooling rate after hot rolling, a steel having all of excellent corrosion resistance, low YP, high BH, and favorable anti-aging properties can be obtained. Moreover, since expensive elements, such as Mo or Cr, are not used, the steel can be manufactured at low cost and a special heat treatment is not required.

The present invention provides a high strength galvanized steel sheet containing, as an ingredient composition of the steel, C: more than 0.015% and lower than 0.100%, Si: 0.3% or lower, Mn: lower than 1.90%, P: 0.015% or more and 0.05% or lower, S: 0.03% or lower, sol.Al: 0.01% or more and 0.5% or lower, N: 0.005% or lower, Cr: lower than 0.30%, B: 0.0003% or more and 0.005% or lower, and Ti: lower than 0.014% in terms of mass %, satisfying $2.2 \leq [Mneq] \leq 3.1$ and $0.42 \leq [\%\ P]+150B^* \leq 0.73$, containing balance iron and inevitable impurities, containing ferrite and a second phase as an microstructure of the steel, in which the second phase area ratio is 3 to 15%, the ratio of the total area ratio of martensite and retained γ to the second phase area ratio is more than 70%, and 50% or more of the area ratio of the second phase exists in the grain boundary triple point.

Here, $[Mneq]=[\%\ Mn]+1.3[\%\ Cr]+8[\%\ P]+150B^*$ and $B^*=[\%\ B]+[\%\ Ti]/48\times10.8\times0.9+[\%\ Al]/27\times10.8\times0.025$ are established and [% Mn], [% Cr], [% P], [% B], [% Ti], and [% Al] represent the content of each of Mn, Cr, P, B, Ti, and sol.Al, respectively. In the case of $B^* \geq 0.0022$, $B^*=0.0022$ is established.

In the high strength galvanized steel sheet of the present invention, Mo: 0.1% or lower is preferable.

In the high strength galvanized steel sheet of the present invention, it is preferable to satisfy $0.48 \leq 8[\%\ P]+150B^* \leq 0.73$.

Furthermore, it is preferable to add at least one of V: 0.4% or lower, Nb: 0.015% or lower, W: 0.15% or lower, Zr: 0.1% or lower, Cu: 0.5% or lower, Ni: 0.5% or lower, Sn: 0.2% or lower, Sb: 0.2% or lower, Ca: 0.01% or lower, Ce: 0.01% or lower, and La: 0.01% or lower in terms of mass %.

The high strength galvanized steel sheet of the invention can be manufactured by a method for manufacturing a high strength galvanized steel sheet including hot rolling and cold rolling a steel slab having the above-described chemical composition, annealing the same at an annealing temperature of higher than 740° C. and lower than 840° C. in a continuous galvanizing and galvannealing line (CGL), cooling the same at an average cooling rate of 2 to 30° C./sec from the annealing temperature to immersion temperature in a galvanizing bath, immersing the same in the galvanizing bath for galvanization, and cooling the same to 100° C. or lower at an average cooling rate of 5 to 100° C./sec after galvanization or further performing alloying treatment of plating after galvanization, and cooling the same to 100° C. or lower at an average cooling rate of 5 to 100° C./sec after the alloying treatment.

According to the method for manufacturing a high strength galvanized steel sheet of the invention, the steel sheet is preferably cooled to 640° C. or lower after hot-rolling at an average cooling rate of 20° C./sec or more, and then coiled at 400 to 620° C.

The present invention has made it possible to manufacture a high strength galvanized steel sheet having excellent corrosion resistance, a low YP, a high BH, and excellent anti-aging properties at low cost without requiring a special CGL heat cycle. The high strength galvanized steel sheet of the invention can increase the strength and reduce the thickness of automotive parts due to excellent corrosion resistance, excellent surface distortion resistance, excellent dent resistance, and excellent anti-aging properties.

DETAILED DESCRIPTION OF THE INVENTION

Figure 1:
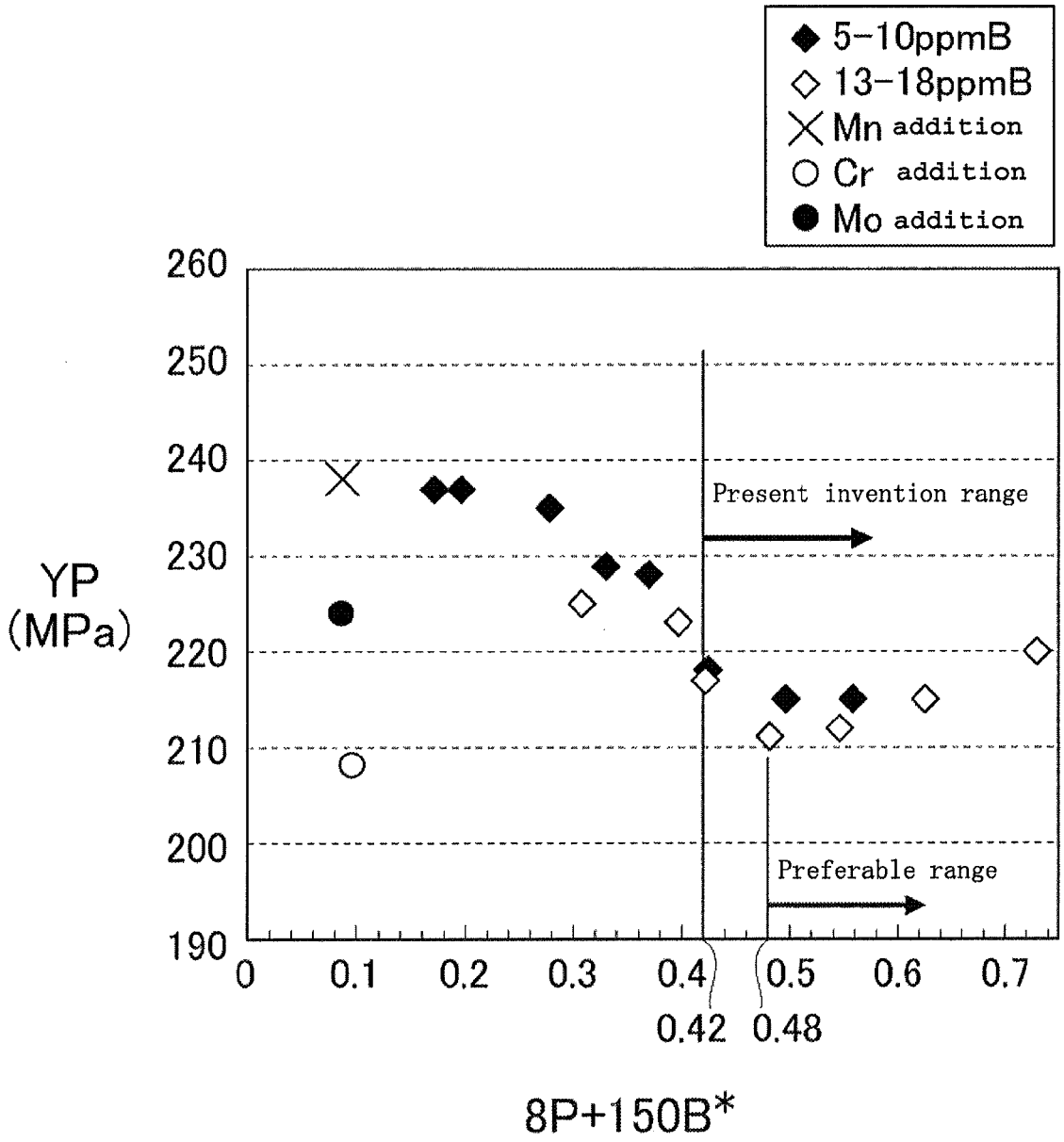
FIG. 1 is a graph illustrating the relationship between YP and 8P+150B* (P represents [% P]).

Hereinafter, the details of embodiments of the invention will be described. Unless otherwise specified, % illustrating the amount of ingredients represents mass %.

1) Chemical Compositions of Steel

Cr: Lower than 0.30%

Cr is an important element that should be strictly controlled in the invention. More specifically, hitherto, Cr has been positively utilized for the purpose of a reduction in YP and an increase in BH. However, it was clarified not only that the Cr is an expensive element but that, when a large amount of Cr is added, Cr remarkably deteriorates the corrosion resistance of hem processed portions. More specifically, when the corrosion resistance under a humid environment of door outer or food outer parts produced with a former composite microstructure steel having a low YP was evaluated, a steel sheet was recognized in which the hole formation resistance life of the hem processed portions decreases by 1 to 4 years compared with that of the conventional 340BH. Furthermore, it was clarified that the deterioration of the corrosion resistance occurs when the Cr content is 0.30% or more and remarkably occurs when the Cr content is 0.40% or more. Thus, in order to secure sufficient corrosion resistance, the Cr content is preferably lower than 0.30%. Cr is an element that can be arbitrarily added from the viewpoint of optimizing the [Mneq] shown below and the lower limit is not specified (including Cr: 0%). From the viewpoint of a reduction in YP, Cr is added in a proportion of preferably 0.02% or more and more preferably 0.05% or more.

[Mneq]: 2.2 or More and 3.1 or Lower

In order to simultaneously secure a low YP and excellent anti-aging properties while securing a high BH, it is advantageous to form a composite microstructure containing ferrite and mainly martensite. Among former steels, there are many steel sheets in which the YP or YR is not sufficiently reduced or the anti-aging properties are insufficient. The examination results of the causes clarified that pearlite or bainite generates as a second phase in addition to the martensite and a small amount of retained γ in such steel sheets. The pearlite is as fine as about 1 to 2 μm and generates adjacent to the martensite. Thus, the pearlite is difficult to be distinguished from the martensite under an optical microscope, and can be identified when observed at a magnification of 3000 times or more using SEM. For example, when the microstructure of a former 0.03% C-1.5% Mn-0.5% Cr steel is examined in detail, only course pearlite is identified and the area ratio of the pearlite or the bainite in the second phase area ratio is measured to be about 10% in the observation under an optical microscope or observation by SEM at a magnification of about 1000 times. When examined in detail by SEM observation at a magnification of 4000 times, the ratio of the pearlite or the bainite in the second phase area ratio is 30 to 40%. By suppressing the pearlite or the bainite, a low YP is obtained while securing a high BH.

In order to sufficiently reduce such fine pearlite or bainite in a CGL heat cycle in which slow cooling is performed after annealing, the hardenability of each element was examined. As a result, it was clarified that, in addition to Mn, Cr, and B that are well known as hardenable elements until now, P also has a high hardenability improvement effect. When B is compositely added with Ti or Al, the hardenability improvement effect notably increases. However, even when B is added in the amount equal to or larger than a given amount, the hardenability improvement effect is saturated. Thus, it was found that the effects are represented as a Mn equivalent formula as in the following formula.

$$[Mneq]=[\%\ Mn]+1.3[\%\ Cr]+8[\%\ P]+150B^*B^*=[\%\ B]+[\%\ Ti]/48\times10.8\times0.9+[\%\ Al]/27\times10.8\times0.025$$

In the case of [% B]=0, B*=0 is established and in the case of B*≥0.0022, B*=0.0022 is established.

Here, [% Mn], [% Cr], [% P], [% B], [% Ti], and [% Al] each represent the content of each of Mn, Cr, P, B, Ti, and sol.Al, respectively.

B* is an index representing the effect of increasing hardenability by leaving a solid solution B by the addition of B, Ti, and Al. In a steel containing no B, the effect due to the addition of B is not obtained, and thus B*=0 is established. When B* is 0.0022 or more, the hardenability improvement effect due to B is saturated, and thus B* is 0.0022 is established.

By setting the [Mneq] to 2.2 or more, pearlite or bainite is sufficiently suppressed also in a CGL heat cycle in which slow cooling is performed after annealing. Thus, in order to obtain excellent anti-aging properties while reducing the YP, the [Mneq] is preferably 2.2 or more. From the viewpoint of a reduction in YP, the [Mneq] is preferably 2.3 or more and more preferably 2.4 or more. When the [Mneq] exceeds 3.1, the addition amount of Mn, Cr, and P becomes extremely large, and thus it is difficult to simultaneously secure a sufficiently low YP, a high BH, and excellent corrosion resistance. Thus, the [Mneq] is 3.1 or lower.

Mn: Lower than 1.90%

As described above, in order to increase the BH while reducing the YP, the optimization of the [Mneq] is at least required. However, only optimizing the [Mneq] is insufficient for increasing the BH while reducing the YP, and the Mn amount or the P content and the B content described later are preferably controlled in a given range. More specifically, Mn is added to increase hardenability and increase the ratio of the martensite in the second phase. However, when the content is excessively large, the $\alpha\rightarrow\gamma$ transformation temperature in an annealing process becomes low and $\gamma$ grains generate at a fine ferrite grain boundary immediately after re-crystallization or at the interface oaf recovery grains during re-crystallization. Thus, the ferrite grains elongate and become non-uniform, the second phase becomes fine, and the YP increases. Simultaneously, the addition of Mn has an action of shifting the Al line of the Fe-c phase diagram to a low temperature side and a low C side to thereby reduce the solid solution C in ferrite and non-uniformly dispersing the second phase. Thus, the addition of Mn remarkably reduces the BH.

Thus, in order to simultaneously obtain a low YP and a high BH, the Mn amount is preferably lower than 1.90%. In order to increase the BH while further reducing the YP, the Mn amount is preferably 1.8% or lower. In order to demonstrate such effects of Mn, Mn is added in a proportion of more than 1.0%.

P: 0.015% or More and 0.05% or Lower

In the invention, P is an important element that achieves a reduction in YP and an increase in BH. More specifically, by blending P in a given range together with B described later, a reduction in YP, an increase in BH, and favorable anti-aging properties are simultaneously obtained at a low manufacturing cost and excellent corrosion resistance is also achieved.

P has been utilized as a solid solution strengthening element. It is considered that the P amount is preferably reduced from the viewpoint of a reduction in YP. However, it was clarified that P has a high hardenability improvement effect even when a slight amount of P is added as described above. Furthermore, it was clarified that P has an effect of uniformly and coarsely dispersing the second phase to the triple point of the ferrite grain boundary or an effect of slightly increasing the BH. Then, a method for reducing the YP and increasing the BH utilizing the hardenability improvement effect of P was extensively examined. As a result, by replacing Mn by P while holding a given [Mneq], the second phase can be very uniformly distributed, the YP decreases, and the BH sharply increases.

In addition, since P is also an element that slightly improves corrosion resistance, the corrosion resistance can be increased while maintaining a favorable material quality by replacing Cr by P. In order to obtain the effect due to the addition of P, P is added in a proportion of 0.015% or more and is preferably added in a proportion of 0.02% or more.

However, when P is added in a proportion of more than 0.05%, the hardenability improvement effect or the effect of uniformalizing or coarsening the microstructure is saturated, and also the solid solution strengthening amount becomes excessively large, and thus a low YP cannot be obtained. The BH increase effect also becomes small. When P is added in a proportion of more than 0.05%, the alloying reaction of a base metal and a plating layer is remarkably delayed to deteriorate the powdering resistance. The weldability also deteriorates. Thus, the P amount is 0.05% or lower.

B: 0.0003% or More and 0.005% or Lower

B has an action of uniformalizing and coarsening ferrite grains, increasing hardenability, and increasing BH. Therefore, a reduction in YP and an increase in BH are achieved by replacing Mn by B while securing a given amount of [Mneq]. By using in combination P having an action of generating a martensite at the grain boundary and B having the action of uniformalizing and coarsening ferrite grains, a steel microstructure containing uniform and coarse ferrite grains and a martensite uniformly dispersed at the grain boundary triple point is obtained, and a reduction in YP and an increase in BH are notably achieved. In order to obtain the effect of the addition of B, B is added in a proportion of at least 0.0003% or more. In order to further demonstrate the effect of reducing the YP due to the addition of B, B is added in a proportion of preferably 0.0005% or more and more preferably more than 0.0010%. However, when B is added in a proportion of more than 0.005%, casting properties and rolling properties remarkably decrease. Therefore, B is 0.005% or lower. From the viewpoint of securing casting properties and rolling properties, B is preferably added in a proportion of 0.004% or lower.

$$0.42\leq8[\%\ P]+150B^*\leq0.73$$

In order to achieve both the reduction in YP and the increase in BH, a P and B* weighting equivalent formula is controlled and optimized in a given range in addition to the content of each of P, B, and Mn. Then, first, changes in mechanical properties when [Mneq] is fixed and P and B are added were examined. The chemical ingredients of a test steel contain C: 0.027%, Si: 0.01%, Mn: 1.5 to 2.2%, P: 0.004 to 0.05%, S: 0.003%, sol.Al: 0.05%, Cr: 0.20%, N: 0.003%, and B: 0.0005 to 0.0018%, and a steel in which the addition amount of Mn and the addition amount of P and B are balanced so that the [Mneq] is almost constant in the range of 2.5 to 2.6 was vacuum-melted. As a comparison, a steel mainly containing Mn having components of P: 0.01%, B: not-added, Mn: 2.2%, and Cr: 0.20%, a steel to which Cr is added having components of P: 0.01%, B: not-added, Mn: 1.6%, and Cr: 0.65%, and a steel to which Mo is added having components of P: 0.01%, B: 0.001%, Mn: 1.6%, Cr: not-added, and Mo: 0.2% were dissolved together. In the steel mainly containing Mn and the steel mainly containing Cr, the [Mneq] is adjusted to 2.5 to 2.6 similarly as in the P and B-added steel.

A slab having a thickness of 27 mm was cut out from the obtained ingot, heated to 1200° C., hot-rolled to 2.8 mm at a finish rolling temperature of 850° C., subjected to water spray cooling immediately after hot rolling, and then coiling treatment for 1 hr at 570° C. The obtained hot-rolled sheet was cold-rolled to 0.75 mm at a cold-rolled reduction of 73%. The obtained cold-rolled sheet was annealed at 780° C. for 40 sec, cooled at an average cooling rate of 7° C./sec from the annealing temperature, immersed in a 460° C. galvanizing bath for galvanization treatment, held at 510° C. for 15 sec for alloying the plating after performing the galvanization treatment, cooled to a temperature range of 100° C. or lower at a cooling rate of 25° C./sec, and skin-pass rolled at an elongation ratio of 0.2%.

From the obtained steel sheet, a tensile test piece of JIS No. 5 was extracted, and subjected to a tensile test (based on JIS Z2241). A difference between a stress after giving 2% prestrain and an upper yield stress after giving 2% prestrain and performing heat-treatment at 170° C. for 20 min, which is equivalent to a bake coating process, was measured to be defined as BH.

Figure 2:
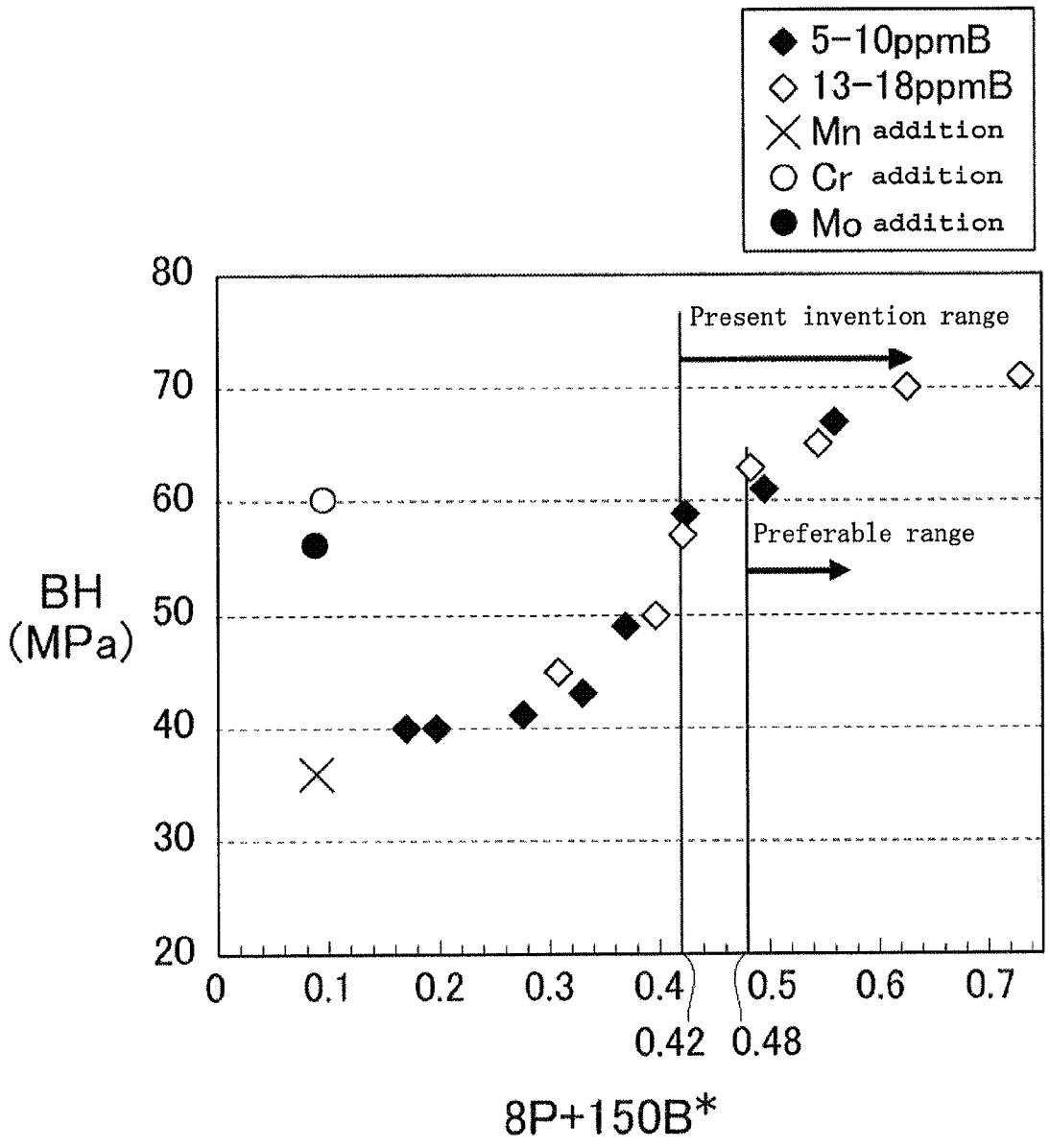
FIG. 2 is a graph illustrating the relationship between BH and 8P+150B* (P represents [% P]).
Figure 3:
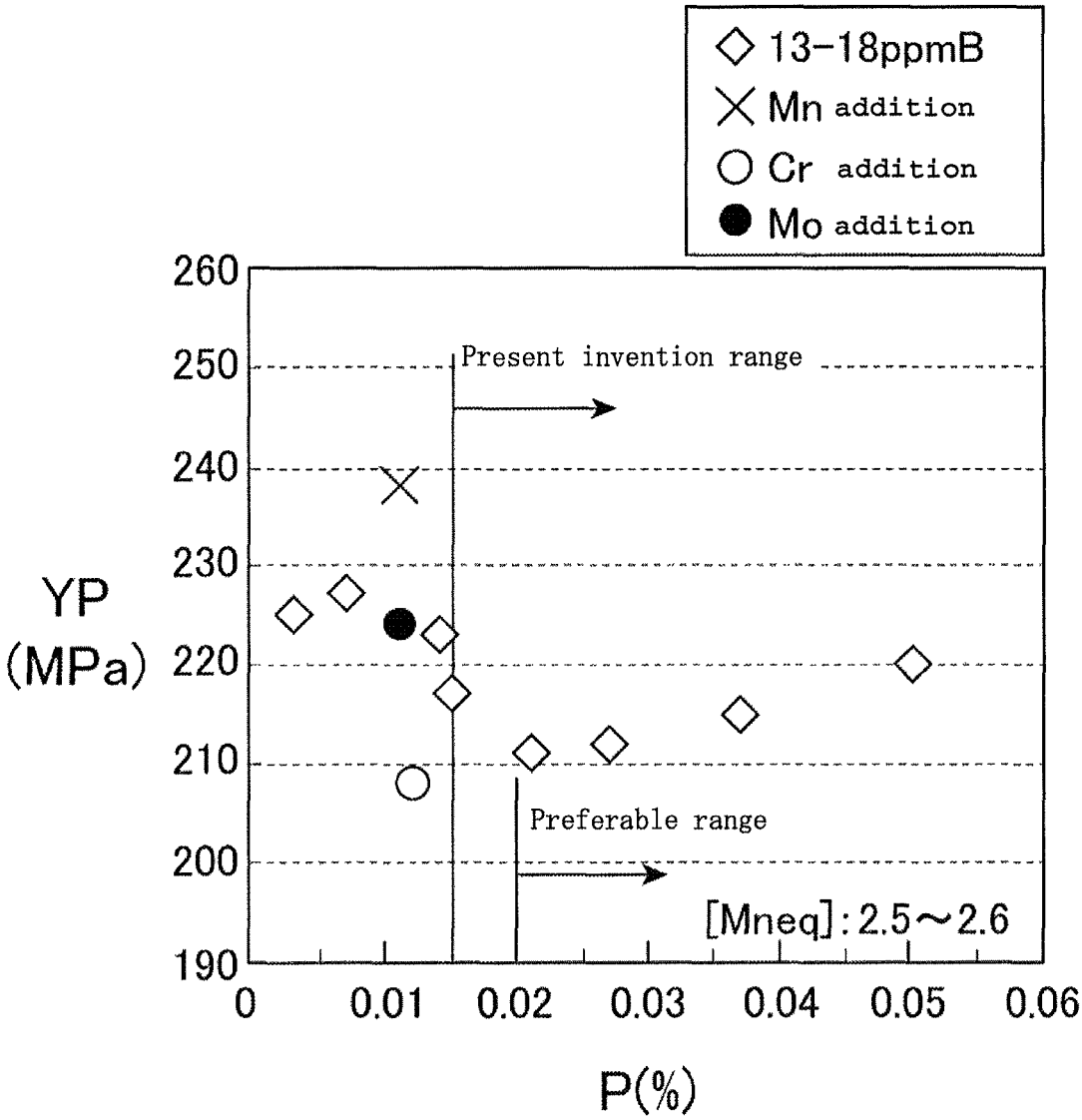
FIG. 3 is a graph illustrating the relationship between YP and the P amount.
Figure 4:
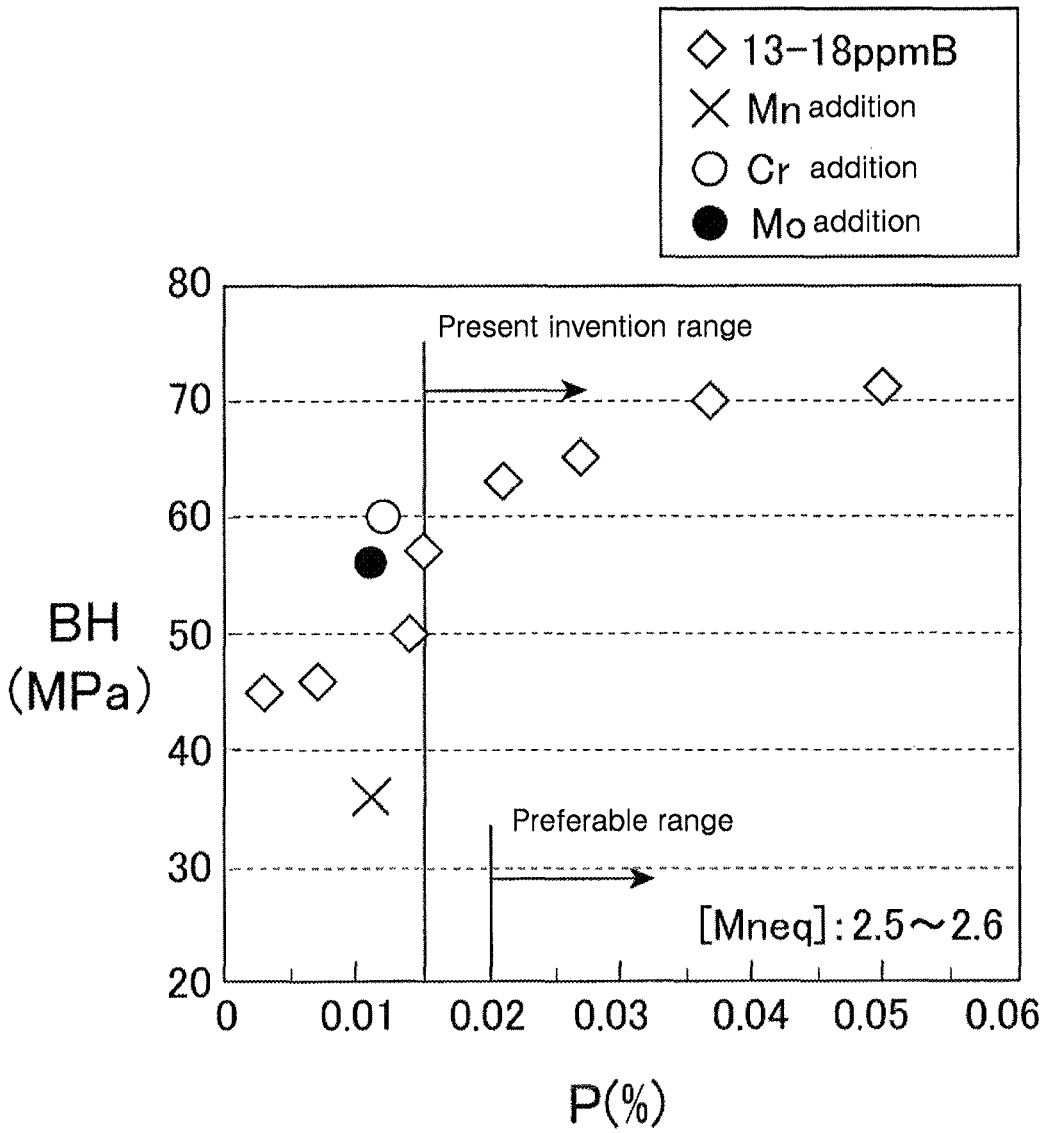
FIG. 4 is a graph illustrating the relationship between BH and the P amount.

The obtained results are illustrated in FIGS. 1 and 2. Here, ♦ represents the mechanical properties of a steel in which P was added to a steel having components such that the addition amount of B is relatively as small as B: 0.0005 to 0.0010% and ◇ represents the mechanical properties of a steel in which P was added to a steel having components such that the addition amount of B is relatively as large as B: 0.0013 to 0.0018%. The mark x represents the mechanical properties of a steel mainly containing Mn, ○ represents the mechanical properties of a steel mainly containing Cr, and ● represents the mechanical properties of a steel to which Mo was added. Thus, the YP becomes low and the BH remarkably increases when 8[% P]+150B* is 0.42 or more. Furthermore, when 8[% P]+150B* becomes 0.48 or more, a much higher BH is obtained while maintaining a low YP. The YP in this case is lower than that of the steel mainly containing Mn or the steel to which Mo was added and shows a low value close to that of the steel to which Cr was added. The BH in this case is much higher than that of the steel mainly containing Mn and shows a value equal to or higher than that of the steel to which Cr was added or the steel to which Mo was added. FIGS. 3 and 4 illustrate the relationship between the YP and the P amount and the BH and the P amount, respectively, in the steel having components such that the addition amount of B is relatively as large as B: 0.0013 to 0.0018% (steel in which B* is almost constant at 0.0019 to 0.0022), the steel mainly containing Mn, the steel mainly containing Cr, and the steel to which Mo was added described in the comparison above. A method for manufacturing a sample is the same as the methods of FIGS. 1 and 2. This shows that by adding P to the steel to which B was added and reducing Mn, a high BH is obtained while maintaining a low YP. It is also found that, in order to obtain such an effect, P is preferably at least 0.015% or more. Each of the above-described steels has a strength of TS≥440 MPa.

Figure 5:
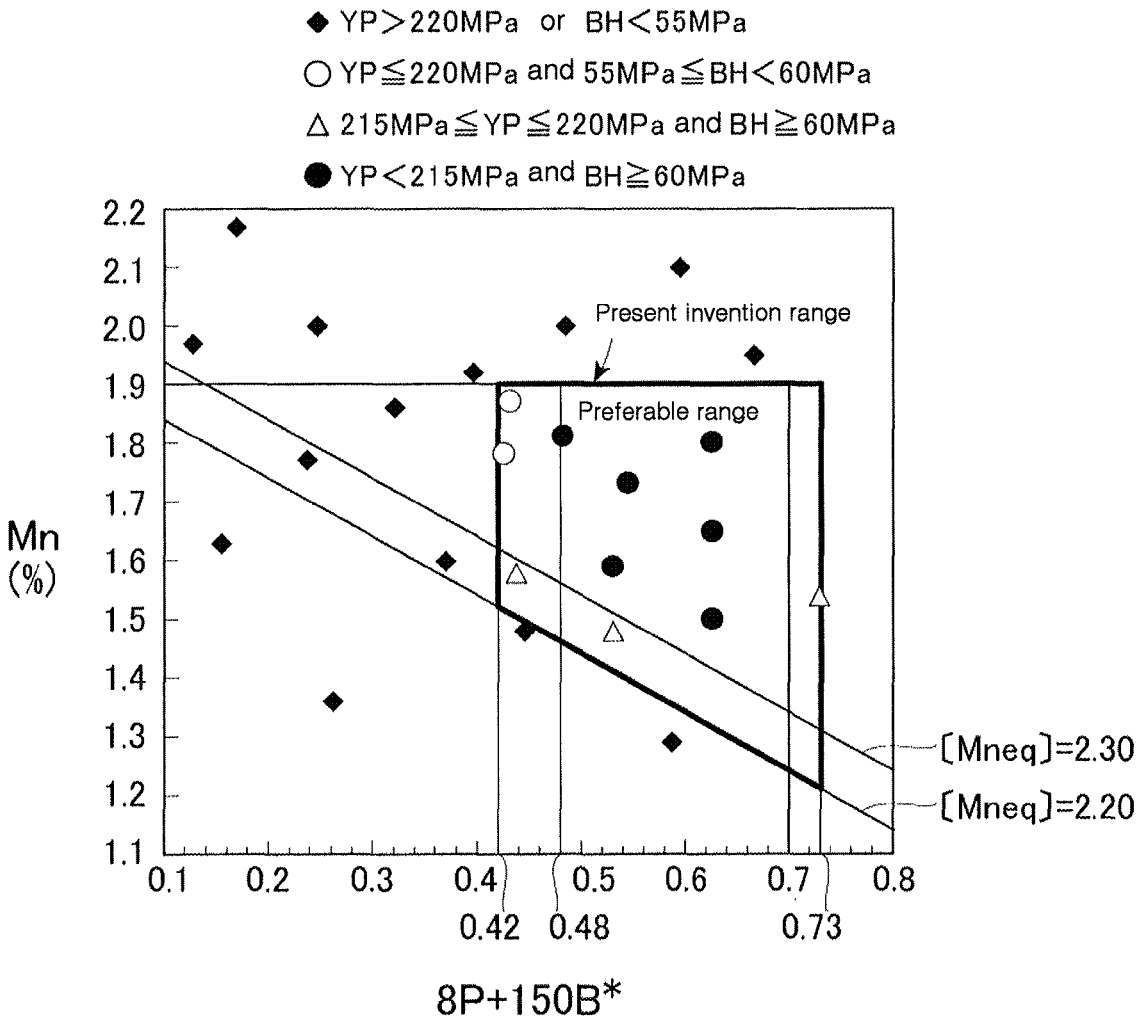
FIG. 5 is a graph illustrating the relationship of YP and BH, Mn, and 8P+150B* (P represents [% P]).

Then, in order to more clarify the proper Mn amount and the range of 8[% P]+150B*, a steel in which the compositions of Mn and P and B were widely changed was examined for the mechanical properties. The chemical compositions other than Mn, P, and B and a method for manufacturing a sample are the same as above. The obtained results are illustrated in FIG. 5. In FIG. 5, ● represents a steel sheet of YP<215 MPa and BH≥60 MPa, Δ represents a steel sheet of 215 MPa≤YP≤220 MPa and BH≥60 MPa, and ○ represents a steel sheet of YP≤220 MPa and 55 MPa≤BH<60 MPa. ♦ represents a steel sheet of YP>220 MPa or BH<55 MPa, which does not satisfy the above-described properties.

This shows that a low YP and a high BH are simultaneously obtained when the [Mneq] is 2.2 or more, the Mn amount is lower than 1.90%, and 0.42≤8[% P]+150B*≤0.73 is satisfied. When satisfying 0.48≤8[% P]+150B*, a higher BH is obtained. By adjusting the [Mneq] to be 2.3 or more and 8[% P]+150B* to be 0.70 or lower, a lower YP and a higher BH are obtained. Such steel sheets have a microstructure constituted by a martensite containing mainly ferrite, in which the amount of pearlite or bainite is reduced. The ferrite grains are uniform and coarse and the martensite is uniformly dispersed mainly at the triple point of the ferrite grains. When 8[% P]+150B* exceeds 0.73, P is preferably added in a proportion of more than 0.05%. Thus, although the microstructure is uniformalized, the solid solution strengthening of P becomes excessively high, and thus a sufficiently low YP is not obtained.

In view of the above, 8[% P]+150B* is 0.42 or more and 0.73 or lower, more preferably 0.48 or more and 0.73 or lower, and still more preferably 0.48 or more and 0.70 or lower.

C: More than 0.015% and Lower than 0.100%

C is an element required in order to secure a given amount of the second phase area ratio. When the C amount is excessively small, a sufficient second phase area ratio cannot be secured, and sufficient anti-aging properties and a low YP are not obtained. In order to obtain the anti-aging properties equal to or more than that of former steel, C is more than 0.015%. From the viewpoint of further increasing anti-aging properties and further reducing YP, C is preferably 0.02% or more. In contrast, when the C amount is 0.100% or more, the second phase area ratio becomes excessively large, the YP increases, and the BH decreases. Moreover, the weldability also deteriorates. Thus, the C amount is lower than 0.100%. In order to obtain a high BH while obtaining a much lower YP, the C amount is preferably lower than 0.060% and more preferably lower than 0.040%.

Si: 0.3% or Lower

By adding a slight amount of Si, an effect of delaying scale generation in hot rolling to improve the surface quality, an effect of moderately delaying an alloying reaction of a base metal and zinc in a plating bath or during alloying treatment, an effect of further uniformalizing and coarsening the micro microstructure of a steel sheet, and the like are obtained. Thus, Si can be added from such a viewpoint. However, when Si is added in a proportion of more than 0.3%, the plating appearance quality deteriorates to make the application to exterior panels difficult and an increase in YP is caused. Thus, the Si amount is 0.3% or lower. From the viewpoint of further increasing the surface quality and reducing the YP, Si is preferably added in a proportion of lower than 0.2%. Si is an element that can be arbitrarily added and the lower limit is not specified (including Si: 0%). From the above-described viewpoint, Si is added in a proportion of 0.01% or more and more preferably 0.02% or more.

S: 0.03% or Lower

By adding a suitable amount of S, primary scale which is formed during hot-rolling becomes easy to break away. Thus, Si can be added. However, when the S content is high, the amount of MnS that precipitates in steel becomes excessively large to reduce the ductility of steel sheets, such as the elongation or the stretch-flangeability, to thereby reduce the press forming properties. Moreover, the ductility of a slab during hot-rolling is reduced and surface defects are easily caused. Furthermore, corrosion resistance is slightly reduced. Thus, the S amount is 0.03% or lower. From the viewpoint of increasing the ductility and the corrosion resistance, S is preferably 0.02% or lower, more preferably 0.01% or lower, and still more preferably 0.002% or lower.

Sol.Al: 0.01% or More and 0.5% or Lower

Al is added for the purpose of fixing N and promoting the hardenability of B, the purpose of increasing anti-aging properties, and the purpose of reducing inclusions and increasing the surface quality. The hardenability improvement effect of Al is low in a steel not containing B and is about 0.1 to 0.2 times that of Mn. However, in a steel containing B, the effect is large even when a small amount of sol.Al is added due to an effect of fixing N as AlN and leaving a solid solution B. Conversely, unless the sol.Al content is optimized, the hardenability improvement effect of B is not obtained, the solid solution N remains, and the anti-aging properties also deteriorate. From the viewpoint of increasing the hardenability improvement effect and anti-aging properties of B, the sol.Al content is 0.01% or more. In order to further demonstrate such effects, sol.Al is added in a proportion of preferably 0.015% or more and more preferably 0.04% or more. In contrast, even when sol.Al is added in a proportion of more than 0.5%, the effect of leaving the solid solution B or the effect of increasing anti-aging properties is saturated and cost increase is caused in vain. Moreover, the casting properties are deteriorated to deteriorate the surface quality. Therefore, sol.Al is 0.5% or lower. From the viewpoint of securing an excellent surface quality, sol.Al is preferably lower than 0.2%.

N: 0.005% or Lower

N is an element that forms nitrides, such as BN, AlN, or TiN in steel and has a harmful effect of eliminating the effect of B through the formation of BN. Moreover, a fine AlN is formed to reduce grain growing properties to cause an increase in YP. Furthermore, when the solid solution N remains, the anti-aging properties deteriorate. From such a viewpoint, N should be strictly controlled. When the N content exceeds 0.005%, the hardenability improvement effect of B is not sufficiently obtained and the YP increases. With a steel having such components, the anti-aging properties deteriorate and the applicability to exterior panels becomes insufficient. In view of the above, the N content is 0.005% or lower. From the viewpoint of effectively utilizing B and reducing the precipitation amount of AlN to further reduce the YP, N is preferably adjusted to be 0.004% or lower.

Mo: 0.1% or Lower

Mo can be added from the viewpoint of increasing hardenability to suppress the generation of pearlite to reduce YR or increasing BH while maintaining favorable anti-aging properties. However, since Mo is a very expensive element, the addition of a large amount of Mo leads to sharp cost increase. When the addition amount of Mo increases, the YP increases. Therefore, when adding Mo, the addition amount of Mo is limited to 0.1% or lower (including Mo: 0%) from the viewpoint of a reduction in YP and a reduction in cost. From the viewpoint of further reducing the YP, the amount of Mo is preferably 0.05% or lower, and more preferably Mo is not added (0.02% or lower).

Ti: Lower than 0.014%

Ti has an effect of fixing N and increasing the hardenability of B, an effect of increasing anti-aging properties, and an effect of increasing casting properties and can be arbitrarily added so as to auxiliary obtain such effects. However, when the content of Ti becomes large, Ti has an action of forming fine precipitates, such as TiC or Ti (C, N), in steel to remarkably increase the YP and also generating TiC during cooling after annealing to reduce the BH. Thus, when added, the Ti content should be controlled in a proper range. When the Ti content is 0.014% or more, the YP remarkably increases and the BH decreases. Thus, the Ti content is lower than 0.014% (including Ti: 0%). In order to fix N by the precipitation of TiN and to demonstrate the hardenability improvement effect of B, the Ti content is preferably 0.002% or more. In order to suppress the precipitation of TiC and obtain a low YP and a high BH, the Ti content is preferably adjusted to be lower than 0.010%.

The balance contains iron and inevitable impurities, and further can contain a given amount content of the following elements.

V: 0.4% or Lower

V is an element that increases hardenability and has a small action of deteriorating a plating quality or corrosion resistance. Thus, V can be utilized as a substitute for Mn or Cr. V is added in a proportion of preferably 0.005% or more and more preferably 0.03% or more from the above-described viewpoint. However, when the addition of more than 0.4% of V leads to a remarkable increase in cost. Thus, V is added in a proportion of 0.4% or lower.

Nb: 0.015% or Lower

Nb has an action of refining a microstructure and precipitating NbC and Nb (C, N) to strengthen a steel sheet and an action of increasing BH by refining ferrite grains. Thus, Nb can be added from the viewpoint of an increase in strength and an increase in BH. Nb is added in a proportion of preferably 0.003% or more and more preferably 0.005% or more from the above-described viewpoint. However, when Nb is added in a proportion of more than 0.015%, the YP remarkably increases. Thus, Nb is preferably added in a proportion of 0.015% or lower.

W: 0.15% or Lower

W can be utilized as a hardenable element and a precipitation strengthening element. W is added in a proportion of preferably 0.01% or more and more preferably 0.03% or more from the above-described viewpoint. However, the addition of an excessive amount of W leads to an increase in YP. Thus, W is preferably added in a proportion of 0.15% or lower.

Zr: 0.1% or Lower

Zr can be similarly utilized as a hardenable element and a precipitation strengthening element. Zr is added in a proportion of preferably 0.01% or more and more preferably 0.03% or more from the above-described viewpoint. However, the addition of an excessive amount of Zr leads to an increase in YP. Thus, Zr is preferably added in a proportion of 0.1% or lower.

Cu: 0.5% or Lower

Cu slightly increases corrosion resistance, and thus is preferably added from the viewpoint of an increase in corrosion resistance. Cu is also an element that is mixed when utilizing scrap as raw materials. By permitting mixing of Cu, recycling materials can be utilized as raw materials to thereby reduce a manufacturing cost. Cu is preferably added in a proportion of 0.02% or more from the above-described viewpoint and more preferably added in a proportion of 0.03 or more from the viewpoint of the improvement of corrosion resistance. However, when the Cu content becomes excessively large, surface defects are caused. Thus, Cu is preferably 0.5% or lower.

Ni: 0.5% or Lower

Ni is also an element having an action of improving corrosion resistance. Ni has an action of reducing surface defects that are likely to occur when Cu is blended. Thus, Ni is preferably added in a proportion of 0.01% or more from the above-described viewpoint and more preferably added in a proportion of 0.02% or more from the viewpoint of improving surface quality while increasing corrosion resistance. When the addition amount of Ni becomes excessively large, the scale generation in a heating furnace becomes non-uniform, surface defects are caused, and the cost remarkably increases. Thus, Ni is 0.5% or lower.

Sn: 0.2% or Lower

Sn is preferably added from the viewpoint of suppressing nitriding or oxidization of a steel sheet surface or decarbonization or removal of B in a tens of micron region of a steel sheet surface layer caused by oxidization. Thus, fatigue characteristics, anti-aging properties, surface quality, and the like are improved. From the viewpoint of suppressing nitriding or oxidization, Sn is preferably added in a proportion of 0.005% or more. The addition of more than 0.2% of Sn causes an increase in YP and deterioration of toughness. Thus, Sn is preferably blended in a proportion of 0.2% or lower.

Sb: 0.2% or Lower

Similarly as Sn, Sb is preferably added from the viewpoint of suppressing nitriding or oxidization of a steel sheet surface or decarbonization or removal of B in a tens of micron region of a steel sheet surface layer caused by oxidization. By suppressing such nitriding or oxidization, a reduction in the generation amount of a martensite in the steel sheet surface layer can be prevented. By preventing a reduction in hardenability due to a reduction in B, fatigue characteristics and anti-aging properties can be improved. Moreover, Sb can increase the wettability of galvanization to increase a plating appearance quality. From the viewpoint of suppressing nitriding or oxidization, Sb is preferably added in a proportion of 0.005% or more. When the amount of Sb exceeds 0.2%, an increase in YP or deterioration of toughness is caused. Thus, Sb is preferably blended in a proportion of 0.2% or lower.

Ca: 0.01% or Lower

Ca has an action of fixing S in steel as CaS, increasing the pH in corrosive living things, and increasing the corrosion resistance of the peripheries of hem processed portions or spot welded portions. The generation of CaS has an action of suppressing the generation of MnS that reduces stretch-flangeability to increase the stretch-flangeability. From such a viewpoint, Ca is preferably added in a proportion of 0.0005% or more. However, Ca is likely to be floated and separated as an oxide in molten steel, and thus a large amount of Ca is difficult to be left in steel. Thus, the content of Ca is 0.01% or lower.

Ce: 0.01% or Lower

Ce can also be added in order to fix S in steel. However, since Ce is an expensive element, the addition of a large amount of Ce leads to cost increase. Therefore, Ce is preferably added in a proportion of 0.0005% or more, and desirably added in a proportion of 0.01% or lower from the above-described viewpoint.

La: 0.01% or Lower

La can also be added in order to fix S in steel. La is preferably added in a proportion of 0.0005% or more from the above-described viewpoint. However, since La is an expensive element, the addition of a large amount of La leads to cost increase. Therefore, La is preferably added in a proportion of 0.01% or lower.

2) Microstructure

The steel sheet microstructure of the invention mainly contains ferrite, a martensite, a slight amount of retained γ, pearlite, and bainite, and further contains a slight amount of carbides in addition thereto. First, a method for measuring the microstructure forms will be described.

The second phase area ratio was determined by etching, with naital, the L cross section (vertical cross section parallel to a rolling direction) of a steel sheet after polishing, observing the same by SEM at a magnification of 4000 times in 10 fields, and then performing image-analysis of taken microstructure photographs. In the microstructure photographs, the ferrite appears as a slightly black contrast region, regions in which carbides generate in the shape of a lamellar or a dotted line are defined as pearlite and bainite, and white contrast grains are defined as a martensite or retained γ. Fine dot-like grains having a diameter of 0.4 μm or lower observed on the SEM photographs are mainly carbides from TEM observation. Since the area ratio thereof is very low, it is considered that the carbides hardly influence the material quality. Thus, here, the grains having a grain diameter of 0.4 μm or lower are excluded from the evaluation of the area ratio or the average grain diameter. The area ratio was calculated for a microstructure containing white contrast grains which is mainly a martensite and contains a slight amount of retained γ, and lamellar or dotted line-like carbides which are pearlite and bainite. The second phase area ratio represents the total amount of these microstructures. Here, the volume fraction of the retained γ is not particularly specified, and, for example, can be determined from the integrated intensity ratio of the {200}, {211}, and {220} planes of α and the {200}, {220}, and {311} planes of γ by X ray diffraction using the X-ray source targeting Co. The anisotropy of the material microstructure is very small in the steel of the invention, and thus the volume ratio and the area ratio of the retained γ are almost equal. Among the second phase grains, grains contacting three or more ferrite grain boundaries are defined as second phase grains present at the triple point of the ferrite grain boundary, and then the area ratio was determined. When second phases were adjacent to each other, the phases in contact with the same width as a grain boundary were separately counted, while the phases in contact with a larger width than a grain boundary, i.e., in contact with a certain width, were counted as one grain.

Second Phase Area Ratio: 3 to 15%

In order to obtain a low YP while securing excellent anti-aging properties, the second phase area ratio is 3% or more. When the second phase fraction is lower than 3%, a high BH is obtained but anti-aging properties deteriorate and the YP increases. When the second phase area ratio exceeds 15%, the YP increases and the BH decreases. Therefore, the second phase area ratio is adjusted in the range of 3 to 15%. In order to obtain a low YP while obtaining a further high BH, the second phase area ratio is preferably 10% or lower and more preferably 7% or lower. Ratio of martensite and retained γ to second phase area ratio: more than 70%

When the [Mneq] is not optimized in the heat cycle of CGL in which slow cooling is performed after annealing, a fine pearlite or bainite generates adjacent to a martensite, which causes an increase in YP, deterioration of anti-aging properties, and a reduction in BH. By optimizing the [Mneq] to suppress the generation of pearlite or bainite and adjusting the ratio of the total area ratio of the martensite and the retained γ to the second phase area ratio to be more than 70%, sufficient anti-aging properties can be secured with a low second phase fraction in the range specified in the invention. In order to give a low YP and a high BH, the ratio of the total area ratio of the martensite and the retained γ to the second phase area ratio is more than 70%.

Ratio of Area Ratio of Second Phase Present at Grain Boundary Triple Point to Second Phase Area Ratios: 50% or More In order to obtain a low YP or a high BH, the second phase fraction or the area ratio of the martensite and the retained γ to the second phase should be controlled in the above-described range. However, simply controlling the same is insufficient, and the second phase position needs to be optimized. More specifically, even in steel sheets having the same second phase fraction and the same ratio of the area ratio of the martensite and the retained γ to the second phase area ratio, a steel sheet in which the second phase is fine and the second phase non-uniformly generates has a high YP. In contrast, it was found that a steel sheet in which the second phase is uniformly and coarsely dispersed mainly at the grain boundary triple point has a low YP and a high BH. It was also found that, in order to obtain such a low YP and a high BH, the ratio of the area ratio of the second phase present at the grain boundary triple point to the second phase area ratios may be controlled to be 50% or more.

Thus, the ratio of the area ratio of the second phase present at the grain boundary triple point to the second phase area ratios is adjusted to be 50% or more.

The reason is not necessarily clear but is presumed as follows. More specifically, TEM observation of the lower microstructure of various steel sheets shows that, in the steel sheets in which the second phase is fine and non-uniformly generates, the martensite is non-uniformly dispersed in a dotted line not only at the grain boundary triple point of the ferrite grains but also at a specific grain boundary other than the triple point. Regions exist in which the interval between martensites is narrow. It was clarified that the regions at the periphery of the martensite where the dislocation is introduced are overlapped with each other when the martensites closely dispersed in a dotted line. It is considered that yielding arises from the periphery of the martensite in a composite microstructure steel containing ferrite and a martensite. When the martensites are densely dispersed, the deformation due to a low stress at the early stage from such the periphery of the martensite is prevented and the YP becomes high. In the steel sheet in which the second phase is uniformly present at the triple point of the grain boundary, the martensites are dispersed with a sufficient large interval. It is considered that plastic deformation from the periphery of the martensite is likely to occur. The cause is not clear but, in the steel sheet in which the second phase is uniformly dispersed, a clear yield point phenomenon, i.e., a phenomenon in which an upper yield point and a lower yield point clearly appear, is recognized in deformation after giving 2% prestrain and heat treatment at 170° C. for 20 min, and the BH becomes high.

Such a microstructure is obtained by adding P or B or by performing forced cooling in a given range in a cooling process after hot rolling, and coiling at a low temperature.

3) Manufacturing Conditions

The steel sheet of the invention can be manufactured, as described above, by a method including hot rolling and cold rolling a steel slab having the ingredient composition specified as above, annealing the same at an annealing temperature of higher than 740° C. and lower than 840° C. in a continuous galvanizing and galvannealing line (CGL), cooling the same from the annealing temperature at an average cooling rate of 2 to 30° C./sec, immersing the same in a galvanizing bath for galvanization, and cooling the same to 100° C. or lower at an average cooling rate of 5 to 100° C./sec after galvanization or further performing alloying treatment of plating after galvanization, and cooling to 100° C. or lower at an average cooling rate of 5 to 100° C./sec after the alloying treatment.

Hot-Rolling

The hot rolling of a steel slab can be carried out by a method for rolling a slab after heating, a method for directly rolling a slab after continuous casting without heating the slab, a method for rolling a slab after continuous casting by heating the same at a short period of time, and the like. The hot-rolling may be carried out in accordance with a standard manner. For example, the slab heating temperature may be 1100 to 1300° C., the finish rolling temperature may be in the range of $Ar_3$ transformation point to $Ar_3$ transformation point 150° C., and the coiling temperature may be 400 to 720° C.

In the steel of the invention, P and the B are compositely added and the transformation of γ→α, pearlite, and bainite after hot-rolling is remarkably delayed. Thus, by controlling the hot rolling conditions in the range shown below, a still higher BH can be obtained.

A steel containing C: 0.024%, Si: 0.01%, Mn: 1.55%, P: 0.035%, S: 0.003%, sol.Al: 0.05%, Cr: 0.20%, N: 0.003%, and B: 0.0018% (Mneq: 2.4, 8P+150B*: 0.59, Steel of the invention) and a steel containing C: 0.024%, Si: 0.01%, Mn: 1.85%, P: 0.01%, S: 0.003%, sol.Al: 0.05%, Cr: not-added, N: 0.003%, and B: 0.0008% (Mneq: 2.1, 8P+150B*:0.29, Comparative steel) were vacuum melted, and the relationship of the BH and the cooling rate after hot-rolling was examined. In manufacturing a sample of the steel of the invention, the average cooling rate up to 640° C. after hot rolling was changed in the range of 2° C./sec to 90° C./sec. Other manufacturing conditions and the method for measuring the BH are the same as above. The results are illustrated in FIG. 6.

Figure 6:
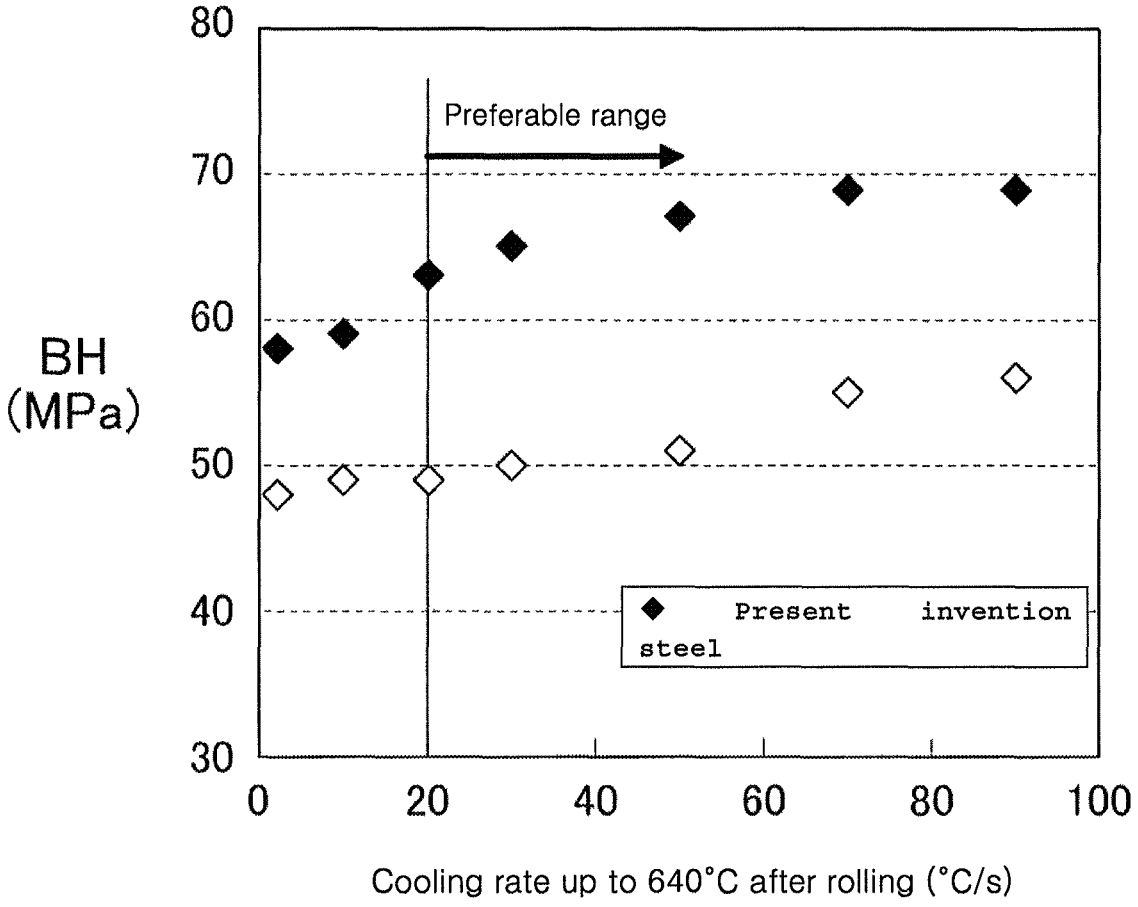
FIG. 6 is a graph illustrating the relationship between the average cooling rate up to 640° C. after hot rolling and the BH.

FIG. 6 shows that the steel of the invention has a BH higher than that of the comparative steel and exhibits a particularly high BH when the cooling rate in hot rolling becomes 20° C./sec or more. A higher BH is exhibited at a cooling rate of 70° C./sec or more. Although a very high cooling rate is required for increasing the BH in the comparative steel, the steel of the invention in which the Mn equivalent is made high and B is utilized obtains an effect of increasing the BH even by moderate forced cooling. This is because former steel requiring a very high cooling rate for vanishing coarse pearlite but, in the steel of the invention in which B is added and the Mn equivalent is made high, coarse perlite disappears and fine pearlite forms a microstructure at a cooling rate of 20° C./sec or more, and a microstructure mainly containing bainite is obtained at a cooling rate of 70° C./sec or more. As a result, the second phase after annealing is more uniformly dispersed at the grain boundary triple point, the ferrite grains are also uniformalized, and the BH increases. The control of such a cooling rate is preferably performed in a temperature range up to 640° C. This is because when forced cooling is stopped at a temperature higher than the range mentioned above, coarse pearlite generates during subsequent slow cooling. The coiling temperature may be in the range of 400 to 620° C. This is because when the coiling temperature is high, coarse pearlite similarly generates when stored for a long period of time after coiling. Thus, the steel of the invention is preferably cooled to a temperature of 640° C. or lower after hot rolling at an average cooling rate of 20° C./sec, and then coiled at 400 to 620° C.

In order to obtain an excellent plating surface quality for exposure panels, it is desirable that descaling be sufficiently performed in order to remove primary and secondary scales that generate at the surface of slab by setting the slab heating temperature to 1250° C. or lower, and the finish rolling temperature be set to 900° C. or lower. When the steel of the invention containing C, Mn, and P is manufactured in accordance with a standard manner, the r value in the direction perpendicular to the rolling direction becomes high and the r value in the rolling direction at 45° becomes low. More specifically, Δr of +0.3 to 0.4 arises. The YP ($YP_D$) in the rolling direction at 45° is higher by 5 to 15 MPa than the YP ($YP_L$) in the rolling direction or YP ($YP_C$) in the direction perpendicular to the rolling direction. From the viewpoint of reducing the planar anisotropy of the r value or the YP, the average cooling rate after hot rolling may be set to 20° C./sec or more or the finish rolling temperature may be set to 830° C. or lower. Thus, the Δr can be suppressed to 0.2 or lower and the $YP_D$–$YP_C$ can be suppressed to 5 MPa or lower, and the surface distortion of the periphery of door handles can be effectively suppressed. By setting the average cooling rate after hot rolling to 70° C./sec or more, Δr can be suppressed to 0.15 or lower. Thus, the cooling rate after hot rolling is desirably controlled in the range.

Cold Rolling

In cold rolling, the rolling reduction may be adjusted to 50 to 85%. From the viewpoint of increasing the r value and increasing the deep drawability, the rolling reduction is preferably adjusted to be 65 to 73%. From the viewpoint of reducing the planar anisotropy of the r value or the YP, the rolling reduction is preferably adjusted to be 70 to 85%.

CGL

The steel sheet after cold rolling is subjected to annealing and plating treatment or further alloying treatment after plating treatment in CGL. The annealing temperature is set to more than 740° C. and lower than 840° C. When the annealing temperature is 740° C. or lower, the solid solution of carbides becomes insufficient, and the second phase area ratio cannot be stably secured. When the annealing temperature is 840° C. or higher, a sufficiently low YP is not obtained. The soaking time may be 20 sec or more in a temperature range of more than 740° C., which is set in usual continuous annealing, and more preferably 40 sec or more.

After annealing, the steel sheet is cooled at an average cooling rate of 2 to 30° C./sec to the temperature of a galvanizing bath usually held at 450 to 500° C. from the annealing temperature. When the cooling rate is lower than 2° C./sec, a large amount of pearlite generates in a temperature range of 500 to 650° C., and a sufficiently low YP is not obtained. In contrast, when the cooling rate becomes 30° C./sec or higher, the $\gamma \rightarrow \alpha$ transformation notably progresses at around 500° C. before and after immersing in a plating bath, the second phase becomes fine, the area ratio of the second phase present at the grain boundary triple point decreases, and the YP increases.

Thereafter, galvanization is carried by immersing in a galvanizing bath. By further holding the same in a temperature range of 470 to 650° C. within 30 sec as required, alloying treatment can also be performed. In former steel sheets in which the [Mneq] is not optimized, the material quality has remarkably deteriorated by performing such alloying treatment. However, in the steel sheet of the invention, an increase in YP is small and a favorable material quality can be obtained.

When performing alloying treatment after galvanization treatment, the steel sheet is cooled to 100° C. or lower after alloying treatment at an average cooling rate of 5 to 100° C./sec. When the cooling rate is lower than 5° C./sec, pearlite generates at around 550° C. and bainite generates in a temperature range of 400° C. to 450° C., which causes an increase in YP. In contrast, when the cooling rate is higher than 100° C./sec, the self-tempering of the martensite generating during continuous cooling becomes insufficient and the martensite becomes excessively hard, and thus the YP increases and the ductility decreases. When facilities in which tempering and refining treatment can be performed are provided, over ageing treatment of 30 sec to 10 min at a temperature of 300° C. or lower can also be performed from the viewpoint of a reduction in YP.

The obtained galvanized steel sheet can be subjected to skin pass rolling from the viewpoint of stabilizing press forming properties, such as adjustment of a surface roughness degree or flattening of a sheet shape. In such a case, from the viewpoint of a low YP and an increase in El, the skin pass elongation rate is preferably 0.2 to 0.6%.

Steels of types A to AO shown in Tables 1 and 2 were smelted, and then continuously casted to a slab having a thickness of 230 mm.

TABLE 1

(mass %)

| Steel type | C | Si | Mn | P | S | sol. Al | N | Cr | Mo | Ti | B | B* | others | [Mneq] | 8[% P] + 150B* | Remarks |
|---|---|---|---|---|---|---|---|---|---|---|---|---|---|---|---|---|
| A | 0.025 | 0.01 | 1.87 | 0.019 | 0.007 | 0.020 | 0.0020 | 0.17 | 0.01 | 0.002 | 0.0013 | 0.0019 | — | 2.53 | 0.438 | Present invention steel |
| B | 0.026 | 0.01 | 1.72 | 0.023 | 0.006 | 0.040 | 0.0032 | 0.21 | 0.01 | 0.005 | 0.0006 | 0.0020 | — | 2.48 | 0.486 | Present invention steel |
| C | 0.027 | 0.01 | 1.55 | 0.032 | 0.002 | 0.072 | 0.0034 | 0.20 | 0.01 | 0 | 0.0017 | 0.0022 | — | 2.40 | 0.586 | Present invention steel |
| D | 0.029 | 0.02 | 1.47 | 0.042 | 0.008 | 0.028 | 0.0027 | 0.22 | 0.02 | 0 | 0.0019 | 0.0022 | — | 2.42 | 0.663 | Present invention steel |
| E | 0.030 | 0.01 | 1.46 | 0.049 | 0.012 | 0.062 | 0.0025 | 0.15 | 0.01 | 0 | 0.0017 | 0.0022 | — | 2.38 | 0.722 | Present invention steel |
| F | 0.030 | 0.02 | 1.80 | 0.015 | 0.002 | 0.012 | 0.0046 | 0.12 | 0.01 | 0.004 | 0.0037 | 0.0022 | — | 2.41 | 0.450 | Present invention steel |

TABLE 1-continued (mass %)

| Steel type | C | Si | Mn | P | S | sol. Al | N | Cr | Mo | Ti | B | B* | others | [Mneq] | 8[% P] + 150B* | Remarks |
|---|---|---|---|---|---|---|---|---|---|---|---|---|---|---|---|---|
| G | 0.024 | 0.01 | 1.50 | 0.024 | 0.007 | 0.052 | 0.0029 | 0.28 | 0.01 | 0 | 0.0022 | 0.0022 | — | 2.39 | 0.522 | Present invention steel |
| H | 0.025 | 0.01 | 1.52 | 0.038 | 0.011 | 0.12 | 0.0011 | 0.27 | 0.02 | 0 | 0.0003 | 0.0015 | — | 2.40 | 0.529 | Present invention steel |
| I | 0.028 | 0.02 | 1.68 | 0.030 | 0.015 | 0.085 | 0.0025 | 0.12 | 0.03 | 0 | 0.0010 | 0.0019 | — | 2.35 | 0.518 | Present invention steel |
| J | 0.035 | 0.01 | 1.49 | 0.024 | 0.001 | 0.073 | 0.0030 | 0.18 | 0.02 | 0 | 0.0014 | 0.0021 | — | 2.24 | 0.512 | Present invention steel |
| K | 0.018 | 0.01 | 1.81 | 0.028 | 0.002 | 0.028 | 0.0030 | 0.27 | 0.01 | 0 | 0.0019 | 0.0022 | — | 2.71 | 0.551 | Present invention steel |
| L | 0.043 | 0.01 | 1.50 | 0.034 | 0.011 | 0.062 | 0.0035 | 0.23 | 0.01 | 0 | 0.0018 | 0.0022 | — | 2.40 | 0.602 | Present invention steel |
| M | 0.064 | 0.16 | 1.50 | 0.038 | 0.008 | 0.035 | 0.0022 | 0.26 | 0.01 | 0 | 0.0018 | 0.0022 | — | 2.46 | 0.627 | Present invention example |
| N | 0.092 | 0.28 | 1.40 | 0.049 | 0.010 | 0.070 | 0.0014 | 0.28 | 0.01 | 0 | 0.0016 | 0.0022 | — | 2.49 | 0.722 | Present invention steel |
| O | 0.030 | 0.01 | 1.72 | 0.018 | 0.008 | 0.26 | 0.0019 | 0.16 | 0.02 | 0 | 0.0005 | 0.0022 | — | 2.40 | 0.474 | Present invention steel |
| P | 0.027 | 0.01 | 1.60 | 0.032 | 0.002 | 0.082 | 0.0012 | 0.22 | 0.08 | 0.005 | 0.0012 | 0.0022 | | 2.47 | 0.586 | Present invention steel |
| Q | 0.027 | 0.01 | 1.55 | 0.024 | 0.001 | 0.030 | 0.0016 | 0.25 | 0.02 | 0.012 | 0.0011 | 0.0022 | | 2.40 | 0.522 | Present invention steel |
| R | 0.022 | 0.01 | 1.54 | 0.038 | 0.013 | 0.056 | 0.0021 | 0.04 | 0.01 | 0 | 0.0022 | 0.0022 | Cu: 0.21, Ni: 0.23 | 2.23 | 0.634 | Present invention steel |
| S | 0.024 | 0.01 | 1.56 | 0.024 | 0.008 | 0.11 | 0.0021 | 0.24 | 0.02 | 0 | 0.0016 | 0.0022 | Nb: 0.007 | 2.39 | 0.522 | Present invention steel |
| T | 0.028 | 0.01 | 1.52 | 0.024 | 0.004 | 0.064 | 0.0017 | 0.14 | 0.01 | 0 | 0.0015 | 0.0021 | V: 0.3 | 2.22 | 0.513 | Present invention steel |
| U | 0.023 | 0.01 | 1.52 | 0.025 | 0.008 | 0.050 | 0.0017 | 0.14 | 0.01 | 0 | 0.0017 | 0.0022 | Zr: 0.04, W: 0.06 | 2.23 | 0.530 | Present invention steel |
| V | 0.026 | 0.01 | 1.57 | 0.028 | 0.008 | 0.048 | 0.0017 | 0.18 | 0.01 | 0 | 0.0017 | 0.0022 | Ca: 0.005, Sb: 0.02 | 2.36 | 0.551 | Present invention steel |
| W | 0.026 | 0.01 | 1.58 | 0.026 | 0.008 | 0.048 | 0.0017 | 0.20 | 0.01 | 0 | 0.0017 | 0.0022 | Ce: 0.004, La: 0.003 Sn: 0.01 | 2.38 | 0.535 | Present invention steel |

TABLE 2

(mass %)

| Steel type | C | Si | Mn | P | S | sol. Al | N | Cr | Mo | Ti | B | B* | others | [Mneq] | 8[% P] + 150B* | Remarks |
|---|---|---|---|---|---|---|---|---|---|---|---|---|---|---|---|---|
| X | 0.029 | 0.01 | 1.89 | 0.023 | 0.009 | 0.053 | 0.0025 | 0.25 | 0.01 | 0 | 0.0009 | 0.0014 | — | 2.61 | 0.399 | Comparative steel |
| Y | 0.025 | 0.01 | 2.10 | 0.022 | 0.004 | 0.020 | 0.0025 | 0.18 | 0.01 | 0 | 0.0005 | 0.0007 | — | 2.62 | 0.281 | Comparative steel |
| Z | 0.017 | 0.01 | 1.92 | 0.022 | 0.009 | 0.052 | 0.0035 | 0.18 | 0.01 | 0 | 0.0004 | 0.0009 | — | 2.47 | 0.314 | Comparative steel |
| AA | 0.040 | 0.01 | 1.94 | 0.022 | 0.012 | 0.067 | 0.0032 | 0.17 | 0.01 | 0 | 0.0003 | 0.0010 | — | 2.48 | 0.322 | Comparative steel |
| AB | 0.085 | 0.08 | 1.93 | 0.030 | 0.006 | 0.042 | 0.0032 | 0.17 | 0.01 | 0 | 0.0003 | 0.0007 | — | 2.50 | 0.348 | Comparative steel |
| AC | 0.029 | 0.01 | 1.68 | 0.059 | 0.008 | 0.030 | 0.0025 | 0.20 | 0.01 | 0 | 0.0009 | 0.0012 | — | 2.59 | 0.652 | Comparative steel |

TABLE 2-continued (mass %)

| Steel type | C | Si | Mn | P | S | sol. Al | N | Cr | Mo | Ti | B | B* | others | [Mneq] | 8[% P] + 150B* | Remarks |
|---|---|---|---|---|---|---|---|---|---|---|---|---|---|---|---|---|
| AD | 0.029 | 0.01 | 1.88 | 0.040 | 0.002 | 0.040 | 0.0024 | 0.16 | 0.01 | 0 | 0 | 0 | — | 2.41 | 0.320 | Comparative steel |
| AE | 0.029 | 0.01 | 1.91 | 0.010 | 0.002 | 0.040 | 0.0030 | 0.10 | 0.01 | 0 | 0.0020 | 0.0022 | — | 2.45 | 0.410 | Comparative steel |
| AF | 0.028 | 0.01 | 1.50 | 0.016 | 0.008 | 0.050 | 0.0036 | 0.32 | 0.01 | 0 | 0.0020 | 0.0022 | — | 2.37 | 0.458 | Comparative steel |
| AG | 0.029 | 0.01 | 1.50 | 0.017 | 0.008 | 0.050 | 0.0036 | 0.59 | 0.01 | 0 | 0 | 0 | — | 2.40 | 0.136 | Comparative steel |
| AH | 0.027 | 0.01 | 1.84 | 0.013 | 0.009 | 0.057 | 0.0032 | 0.04 | 0.21 | 0 | 0.0008 | 0.0014 | — | 2.20 | 0.310 | Comparative steel |
| AI | 0.027 | 0.01 | 1.72 | 0.030 | 0.004 | 0.055 | 0.0030 | 0.18 | 0.01 | 0.018 | 0.0010 | 0.0022 | — | 2.52 | 0.570 | Comparative steel |
| AJ | 0.010 | 0.01 | 1.75 | 0.028 | 0.002 | 0.056 | 0.0027 | 0.20 | 0.01 | 0 | 0.0015 | 0.0021 | — | 2.54 | 0.533 | Comparative steel |
| AK | 0.029 | 0.01 | 1.72 | 0.030 | 0.003 | 0.069 | 0.0060 | 0.18 | 0.01 | 0 | 0.0033 | 0.0022 | — | 2.52 | 0.570 | Comparative steel |
| AL | 0.029 | 0.01 | 1.50 | 0.018 | 0.003 | 0.069 | 0.0020 | 0.20 | 0.01 | 0 | 0.0009 | 0.0016 | — | 2.14 | 0.383 | Comparative steel |
| AM | 0.027 | 0.01 | 1.70 | 0.025 | 0.002 | 0.050 | 0.0020 | 0.16 | 0 | 0.004 | 0.0020 | 0.0022 | — | 2.44 | 0.530 | Present invention steel |
| AN | 0.041 | 0.11 | 1.71 | 0.028 | 0.002 | 0.068 | 0.0026 | 0.09 | 0 | 0.003 | 0.0022 | 0.0022 | — | 2.38 | 0.554 | Present invention steel |
| AO | 0.025 | 0.01 | 1.78 | 0.033 | 0.004 | 0.032 | 0.0019 | 0 | 0 | 0 | 0.0020 | 0.0022 | — | 2.37 | 0.594 | Present invention steel |

The slabs were heated to 1180 to 1250° C., and then hot rolled in a finish rolling temperature range of 820 to 890° C. Thereafter, as shown in Tables 3 and 4, the slabs were cooled to 640° C. or lower at an average cooling rate of 15 to 80° C./sec, and then coiled at coiling temperature CT: 400 to 650° C. The obtained hot-rolled sheets were cold rolled at a rolling reduction of 70 to 77%, thereby obtaining cold-rolled sheets having a sheet thickness of 0.75 mm.

The obtained cold-rolled sheets were annealed at an annealing temperature AT shown in Tables 3 and 4 in CGL, cooled by adjusting the average cooling rate from the annealing temperature AT to a plating bath temperature to the primary cooling rates shown in Tables 3 and 4, and then immersed in a galvanizing bath for galvanization. The steel sheets that were not alloyed after galvanization treatment were cooled to 100° C. or lower after galvanization by adjusting the average cooling rate from the plating bath temperature to 100° C. at the secondary cooling rates shown in Tables 3 and 4. The steel sheets that were alloyed after galvanization treatment were cooled to 100° C. or lower after the alloying treatment by adjusting the average cooling rate from the plating bath temperature to 100° C. at the secondary cooling rates shown in Tables 3 and 4. The galvanization was carried at a bath temperature of 460° C. and at Al in the bath: 0.13%. The alloying treatment was performed after immersing in the plating bath by heating the steel sheets to 480 to 540° C. at an average heating rate of 15° C./sec, and holding the same for 10 to 25 sec so that the Fe content in the plating was in the range of 9 to 12%. The plating was performed to both surfaces at a plating coating weight of 45 g/m$^2$ per one side. The obtained galvanized steel sheets were subjected to skin-pass rolling at an elongation ratio of 0.2%, and then samples were extracted.

The obtained samples were examined by the previously-described method for the second phase area ratio, the ratio of the area ratio of the martensite and the retained γ to the second phase area ratio (ratio of the martensite and the retained γ in the second phase), and the ratio of the area ratio of the second phase present at the grain boundary triple point to the second phases area ratio (ratio of the second phase present at the grain boundary triple point among the second phases). The steel microstructure type was distinguished by SEM observation, and the volume ratio of the retained γ was measured by the previously-described method using X ray diffraction. JIS No. 5 test pieces were extracted in the direction perpendicular to rolling direction, and a tensile test (based on JIS Z2241) was carried out to evaluate the YP, TS, YR (=YP/TS), and El.

Prestrain of 2% tensile strain was given to the same test pieces as above, and heat treatment was performed at 170° C. for 20 min. The difference between the stress after giving 20 prestrain and the YP after giving heat treatment at 170° C. for 20 min was defined as the BH. The mechanical properties after holding at 50° C. for 3 months were similarly examined, and then the anti-aging properties were evaluated based on the YPEl occurrence degree.

The corrosion resistance of each steel sheet was evaluated in structures imitating peripheries of hem processed portions and spot-welded portions. More specifically, two of the obtained steel sheets were laminated and spot welded, so that the steel sheets were stuck to each other, subjected to chemical conversion treatment and electrodeposition coating imitating a coating process in actual vehicles, and then subjected to a corrosion test under SAE J2334 corrosion cycle conditions. The electrodeposition coating film thickness was 20 μm. From corrosion samples after 90 cycles passed, corrosion products were removed, and a reduction in the sheet thickness from the initial sheet thickness measured beforehand was determined to be used as a weight loss due to corrosion.

The results are shown in Tables 3 and 4.

TABLE 3

| | | Hot rolling conditions | | Annealing conditions | | | | Microstructure | | | | | | Mechanical properties | | | | | | | | |
|---|---|---|---|---|---|---|---|---|---|---|---|---|---|---|---|---|---|---|---|---|---|---|
| Steel No. | Steel type | Cooling rage after hot rolling (° C./s) | CT (° C.) | AT (° C.) | Primary cooling rate (° C./s) | Second-ary cooling rate (° C./s) | Pres-ence of alloying treat-ment | Second phase area ratio (%) | Ratio of mar-tensite and retained γ in second phase (%) | Ferrite area ratio (%) | Ratio of second phase present at grain boundary triple point among second phase (%) | Micro-structure type | Volume ratio of retained γ (%) | YP (MPa) | TS (MPa) | YR (%) | BH (MPa) | El (%) | TS × El (MPa × %) | YPEl after 50° C. over aging (%) | Weight lose due to corro-sion (mm) | Remarks |
| 1 | A | 30 | 540 | 770 | 5 | 25 | Done | 5 | 100 | 95 | 56 | F + M/γ | 2 | 219 | 461 | 48 | 55 | 35.1 | 16181 | 0 | 0.34 | Present invention example |
| 2 | B | 35 | 520 | 780 | 5 | 25 | Done | 4 | 97 | 96 | 65 | F + M/γ + B | 1 | 214 | 459 | 47 | 61 | 36.2 | 16616 | 0 | 0.33 | Present invention example |
| 3 | C | 70 | 620 | 780 | 5 | 25 | Done | 4 | 95 | 96 | 80 | F + M/γ + B | 2 | 213 | 457 | 47 | 67 | 36.6 | 16726 | 0 | 0.32 | Present invention example |
| 4 | | 35 | | | 5 | 25 | Done | 4 | 93 | 96 | 79 | F + M/γ + B | 2 | 211 | 455 | 46 | 64 | 37.0 | 16835 | 0 | 0.32 | Present invention example |
| 5 | | 35 | | | 5 | 25 | None | 5 | 100 | 95 | 81 | F + M/γ | 2 | 208 | 459 | 45 | 66 | 37.2 | 17076 | 0 | 0.32 | Present invention example |
| 6 | | 20 | | | 5 | 25 | Done | 4 | 95 | 96 | 76 | F + M/γ + B | 2 | 211 | 455 | 46 | 62 | 37.1 | 16881 | 0 | 0.32 | Present invention example |
| 7 | | 15 | | | 5 | 25 | Done | 4 | 95 | 96 | 69 | F + M/γ + B | 2 | 210 | 453 | 46 | 58 | 37.4 | 16942 | 0 | 0.30 | Present invention example |
| 8 | | 35 | 400 | | 5 | 25 | Done | 4 | 93 | 96 | 80 | F + M/γ + B | 2 | 212 | 455 | 47 | 65 | 37.0 | 16835 | 0 | 0.32 | Present invention example |
| 9 | | 35 | 640 | | 5 | 25 | Done | 4 | 94 | 96 | 72 | F + M/γ + B | 2 | 212 | 449 | 47 | 59 | 37.4 | 16793 | 0 | 0.33 | Present invention example |
| 10 | | 20 | | | 5 | 25 | Done | 4 | 94 | 96 | 72 | F + M/γ + B | 2 | 211 | 448 | 47 | 55 | 37.6 | 16845 | 0 | 0.33 | Present invention example |
| 11 | D | 35 | 520 | 780 | 5 | 25 | Done | 4 | 95 | 96 | 86 | F + M/γ + B | 2 | 214 | 453 | 47 | 68 | 37.5 | 16988 | 0 | 0.29 | Present invention example |

TABLE 3-continued

| Steel No. | Steel type | Hot rolling conditions: Cooling rage after hot rolling (° C./s) | Hot rolling conditions: CT (° C.) | Annealing conditions: AT (° C.) | Annealing conditions: Primary cooling rate (° C./s) | Annealing conditions: Secondary cooling rate (° C./s) | Presence of alloying treatment | Microstructure: Second phase area ratio (%) | Microstructure: Ratio of martensite and retained γ in second phase (%) | Microstructure: Ferrite area ratio (%) | Microstructure: Ratio of second phase present at grain boundary triple point among second phase (%) | Microstructure: Microstructure type | Microstructure: Volume ratio of retained γ (%) | Mechanical properties: YP (MPa) | Mechanical properties: TS (MPa) | Mechanical properties: YR (%) | Mechanical properties: BH (MPa) | Mechanical properties: El (%) | Mechanical properties: TS × El (MPa × %) | Mechanical properties: YPEl after 50° C. over aging (%) | Weight lose due to corrosion (mm) | Remarks |
|---|---|---|---|---|---|---|---|---|---|---|---|---|---|---|---|---|---|---|---|---|---|---|
| 12 | E | 35 | 520 | 780 | 5 | 25 | Done | 4 | 93 | 96 | 90 | F + M/γ + B | 2 | 220 | 460 | 48 | 69 | 37.2 | 17112 | 0 | 0.28 | Present invention example |
| 13 | F | 40 | 560 | 780 | 5 | 25 | Done | 5 | 95 | 95 | 60 | F + M/γ + B | 1 | 218 | 458 | 48 | 57 | 36.2 | 16580 | 0 | 0.31 | Present invention example |
| 14 | G | 80 | 520 | 780 | 5 | 25 | Done | 4 | 95 | 96 | 78 | F + M/γ + B | 2 | 207 | 455 | 45 | 73 | 36.9 | 16790 | 0 | 0.35 | Present invention example |
| 15 | | 35 | 520 | 735 | 5 | 25 | Done | 2 | 100 | 98 | 70 | F + M | 0 | 258 | 452 | 57 | 70 | 37.4 | 16905 | 0.6 | 0.36 | Comparative example |
| 16 | | | | 755 | 5 | 25 | Done | 3 | 97 | 97 | 73 | F + M/γ + B | 1 | 201 | 451 | 45 | 71 | 37.4 | 16867 | 0 | 0.35 | Present invention example |
| 17 | | | | 780 | 5 | 25 | Done | 4 | 93 | 95 | 73 | F + M/γ + B | 2 | 204 | 452 | 45 | 70 | 37.5 | 16950 | 0 | 0.35 | Present invention example |
| 18 | | | | 830 | 5 | 25 | Done | 4 | 88 | 96 | 68 | F + M/γ + B | 2 | 218 | 463 | 47 | 71 | 37.0 | 17131 | 0 | 0.36 | Present invention example |
| 19 | | | | 780 | 1 | 25 | Done | 3 | 48 | 97 | 78 | F + M + P | 0 | 264 | 440 | 60 | 50 | 35.2 | 15488 | 0.5 | 0.36 | Comparative example |
| 20 | | | | 780 | 10 | 15 | Done | 4 | 93 | 96 | 69 | F + M/γ + B | 2 | 208 | 454 | 46 | 70 | 37.5 | 17025 | 0 | 0.36 | Present invention example |
| 21 | | | | 780 | 50 | 25 | Done | 5 | 60 | 95 | 43 | F + M/γ + B | 2 | 238 | 462 | 52 | 68 | 38.0 | 16632 | 0.5 | 0.35 | Comparative example |
| 22 | | | | 780 | 5 | 3 | Done | 3 | 52 | 97 | 48 | F + M/γ + B | 2 | 264 | 448 | 59 | 67 | 34.5 | 16456 | 0.6 | 0.35 | Comparative example |
| 23 | | 15 | 520 | 780 | 5 | 25 | Done | 4 | 95 | 96 | 69 | F + M/γ + B | 2 | 202 | 450 | 45 | 65 | 37.7 | 16965 | 0 | 0.35 | Present invention example |

TABLE 3-continued

| | | Hot rolling conditions | | Annealing conditions | | | | Microstructure | | | | | | Mechanical properties | | | | | | | | |
|---|---|---|---|---|---|---|---|---|---|---|---|---|---|---|---|---|---|---|---|---|---|---|
| Steel No. | Steel type | Cooling rage after hot rolling (° C./s) | CT (° C.) | AT (° C.) | Primary cooling rate (° C./s) | Second-ary cooling rate (° C./s) | Pres-ence of alloying treat-ment | Second phase area ratio (%) | Ratio of mar-tensite and retained γ in second phase (%) | Ferrite area ratio (%) | Ratio of second phase present at grain boundary triple point among second phase (%) | Micro-structure type | Volume ratio of retained γ (%) | YP (MPa) | TS (MPa) | YR (%) | BH (MPa) | El (%) | TS × El (MPa × %) | YPEl after 50° C. over aging (%) | Weight lose due to corro-sion (mm) | Remarks |
| 24 | | 35 | 640 | 780 | 5 | 25 | Done | 4 | 95 | 96 | 68 | F + M/γ + B | 2 | 203 | 452 | 45 | 65 | 37.4 | 16905 | 0 | 0.37 | Present invention example |
| 25 | | 35 | 520 | 800 | 5 | 25 | Done | 4 | 93 | 96 | 73 | F + M/γ + B | 1 | 204 | 452 | 45 | 70 | 37.3 | 16860 | 0 | 0.35 | Present invention example |
| 26 | | 35 | 520 | 800 | 5 | 25 | Done | 4 | 93 | 96 | 73 | F + M/γ + B | 1 | 204 | 452 | 45 | 70 | 37.3 | 16860 | 0 | 0.35 | Present invention example |
| 27 | H | 40 | 520 | 780 | 5 | 25 | Done | 4 | 93 | 96 | 78 | F + M/γ + B | 2 | 213 | 450 | 47 | 64 | 37.5 | 16875 | 0 | 0.32 | Present invention example |
| 28 | I | 35 | 560 | 780 | 5 | 25 | Done | 4 | 84 | 96 | 74 | F + M/γ + P + B | 2 | 214 | 450 | 48 | 62 | 35.8 | 16110 | 0 | 0.28 | Present invention example |
| 29 | J | 35 | 560 | 780 | 5 | 25 | Done | 4 | 76 | 96 | 72 | F + M/γ + P + B | 1 | 220 | 455 | 48 | 64 | 34.8 | 15834 | 0 | 0.32 | Present invention example |

F: Ferrite,
M/γ: Martensite or a small amount of retained γ,
P: Perlite,
B: Bainite

TABLE 4

| | | Hot rolling conditions | | Annealing conditions | | | | Microstructure | | | | | | Mechanical properties | | | | | | | | |
|---|---|---|---|---|---|---|---|---|---|---|---|---|---|---|---|---|---|---|---|---|---|---|
| Steel No. | Steel type | Cooling rage after hot rolling (° C./s) | CT (° C.) | AT (° C.) | Primary cooling rate (° C./s) | Secondary cooling rate (° C./s) | Presence of alloying treatment | Second phase area ratio (%) | Ratio of martensite and retained γ in second phase (%) | Ferrite area ratio (%) | Ratio of second phase present at grain boundary triple point among second phase (%) | Microstructure type | Volume ratio of retained γ (%) | YP (MPa) | TS (MPa) | YR (%) | BH (MPa) | El (%) | TS × El (MPa × %) | YPEl after 50° C. over aging (%) | Weight lose due to corrosion (mm) | Remarks |
| 30 | K | 30 | 540 | 790 | 5 | 25 | Done | 3 | 100 | 97 | 70 | F + M/γ | 1 | 212 | 434 | 49 | 65 | 38.5 | 16709 | 0 | 0.35 | Present invention example |
| 31 | L | 25 | 560 | 780 | 5 | 25 | Done | 7 | 95 | 93 | 76 | F + M/γ + B | 3 | 230 | 496 | 46 | 60 | 34.9 | 17310 | 0 | 0.34 | Present invention example |
| 32 | M | 25 | 570 | 780 | 5 | 25 | Done | 10 | 92 | 90 | 75 | F + M/γ + B | 3 | 248 | 542 | 46 | 56 | 32.8 | 17778 | 0 | 0.35 | Present invention example |
| 33 | N | 25 | 570 | 770 | 5 | 25 | Done | 12 | 91 | 88 | 78 | F + M/γ + B | 4 | 274 | 594 | 46 | 53 | 29.8 | 17701 | 0 | 0.35 | Present invention example |
| 34 | O | 20 | 550 | 780 | 5 | 25 | Done | 4 | 95 | 96 | 62 | F + M/γ + B | 1 | 210 | 466 | 45 | 59 | 35.8 | 16683 | 0 | 0.32 | Present invention example |
| 35 | P | 40 | 550 | 780 | 5 | 25 | Done | 5 | 100 | 95 | 80 | F + M/γ | 2 | 220 | 460 | 48 | 62 | 34.8 | 16008 | 0 | 0.34 | Present invention example |
| 36 | Q | 40 | 540 | 780 | 5 | 25 | Done | 4 | 95 | 96 | 72 | F + M/γ + B + P | 1 | 220 | 464 | 47 | 60 | 35.6 | 16618 | 0 | 0.35 | Present invention example |
| 37 | R | 50 | 560 | 780 | 5 | 25 | Done | 4 | 90 | 96 | 82 | F + M/γ + B | 2 | 220 | 467 | 47 | 58 | 36.5 | 15579 | 0 | 0.25 | Present invention example |
| 38 | S | 45 | 560 | 780 | 5 | 25 | Done | 4 | 95 | 96 | 70 | F + M/γ + B | 2 | 219 | 462 | 47 | 62 | 35.8 | 16540 | 0 | 0.35 | Present invention example |
| 39 | T | 30 | 560 | 780 | 5 | 25 | Done | 4 | 98 | 96 | 70 | F + M/γ + B | 2 | 210 | 454 | 46 | 63 | 36.2 | 16435 | 0 | 0.30 | Present invention example |
| 40 | U | 30 | 560 | 780 | 5 | 25 | Done | 4 | 95 | 96 | 71 | F + M/γ + B + P | 2 | 220 | 470 | 47 | 60 | 35.4 | 16638 | 0 | 0.31 | Present invention example |

TABLE 4-continued

| | | Hot rolling conditions | | Annealing conditions | | | | Microstructure | | | | | | Mechanical properties | | | | | | | | |
|---|---|---|---|---|---|---|---|---|---|---|---|---|---|---|---|---|---|---|---|---|---|---|
| Steel No. | Steel type | Cooling rage after hot rolling (° C./s) | CT (° C.) | AT (° C.) | Primary cooling rate (° C./s) | Second-ary cooling rate (° C./s) | Pres-ence of alloying treat-ment | Second phase area ratio (%) | Ratio of mar-tensite and retained γ in second phase (%) | Ferrite area ratio (%) | Ratio of second phase present at grain boundary triple point among second phase (%) | Micro-structure type | Volume ratio of retained γ (%) | YP (MPa) | TS (MPa) | YR (%) | BH (MPa) | El (%) | TS × El (MPa × %) | YPEl after 50° C. over aging (%) | Weight lose due to corro-sion (mm) | Remarks |
| 41 | V | 40 | 530 | 780 | 5 | 25 | Done | 4 | 93 | 96 | 74 | F + M/γ + B | 2 | 211 | 456 | 46 | 63 | 37.1 | 16918 | 0 | 0.29 | Present invention example |
| 42 | W | 40 | 530 | 780 | 5 | 25 | Done | 4 | 93 | 96 | 74 | F + M/γ + B | 2 | 210 | 454 | 46 | 62 | 37.2 | 16889 | 0 | 0.30 | Present invention example |
| 43 | X | 40 | 540 | 780 | 5 | 25 | Done | 5 | 100 | 95 | 48 | F + M/γ | 1 | 228 | 464 | 49 | 62 | 34.0 | 15776 | 0 | 0.33 | Com-parative example |
| 44 | | 15 | 540 | 780 | 5 | 25 | Done | 5 | 100 | 95 | 48 | F + M/γ | 1 | 223 | 459 | 49 | 48 | 34.4 | 15790 | 0 | 0.35 | Com-parative example |
| 45 | | 15 | 540 | 780 | 5 | 25 | Done | 5 | 100 | 95 | 48 | F + M/γ | 1 | 228 | 464 | 49 | 49 | 34.0 | 15776 | 0 | 0.34 | Com-parative example |
| 46 | Y | 40 | 540 | 780 | 5 | 25 | Done | 4 | 100 | 96 | 35 | F + M/γ | 1 | 232 | 472 | 49 | 42 | 33.2 | 15670 | 0 | 0.30 | Com-arative example |
| 47 | Z | 40 | 540 | 780 | 5 | 25 | Done | 3 | 95 | 97 | 40 | F + M/γ + B | 1 | 225 | 433 | 52 | 53 | 35.9 | 16546 | 0 | 0.31 | Com-parative example |
| 48 | AA | 50 | 540 | 780 | 5 | 25 | Done | 7 | 95 | 93 | 41 | F + M/γ + B | 2 | 252 | 494 | 51 | 39 | 31.8 | 16709 | 0 | 0.30 | Com-parative example |
| 49 | AB | 50 | 540 | 780 | 5 | 25 | Done | 10 | 98 | 90 | 43 | F + M/γ + B | 3 | 324 | 695 | 54 | 36 | 27.9 | 16601 | 0 | 0.30 | Com-parative example |
| 50 | AC | 50 | 540 | 780 | 5 | 25 | Done | 4 | 100 | 96 | 87 | F + M/γ | 2 | 235 | 473 | 50 | 67 | 35.8 | 16826 | 0 | 0.29 | Com-parative example |
| 51 | AD | 30 | 540 | 780 | 5 | 25 | Done | 4 | 93 | 96 | 47 | F + M/γ + B | 2 | 233 | 468 | 50 | 49 | 34.4 | 16099 | 0 | 0.28 | Com-parative example |
| 52 | AE | 30 | 540 | 780 | 5 | 25 | Done | 5 | 96 | 96 | 48 | F + M/γ + B | 1 | 228 | 459 | 50 | 60 | 34.1 | 15652 | 0 | 0.30 | Com-parative example |

TABLE 4-continued

| | | Hot rolling conditions | | Annealing conditions | | | | Microstructure | | | | | | Mechanical properties | | | | | | | | |
|---|---|---|---|---|---|---|---|---|---|---|---|---|---|---|---|---|---|---|---|---|---|---|
| Steel No. | Steel type | Cooling rage after hot rolling (° C./s) | CT (° C.) | AT (° C.) | Primary cooling rate (° C./s) | Second-ary cooling rate (° C./s) | Pres-ence of alloying treat-ment | Second phase area ratio (%) | Ratio of mar-tensite and retained γ in second phase (%) | Ferrite area ratio (%) | Ratio of second phase present at grain boundary triple point among second phase (%) | Micro-structure type | Volume ratio of retained γ (%) | YP (MPa) | TS (MPa) | YR (%) | BH (MPa) | El (%) | TS × El (MPa × %) | YPEl after 50° C. over aging (%) | Weight lose due to corro-sion (mm) | Remarks |
| 53 | AF | 30 | 540 | 780 | 5 | 25 | Done | 4 | 93 | 96 | 74 | F + M/γ + B | 1 | 212 | 458 | 46 | 59 | 36.8 | 16854 | 0 | 0.45 | Com-parative example |
| 54 | AG | 40 | 540 | 780 | 5 | 25 | Done | 4 | 93 | 96 | 74 | F + M/γ + B | 1 | 209 | 459 | 46 | 58 | 37.1 | 17029 | 0 | 0.75 | Com-parative example |
| 55 | AH | 40 | 540 | 780 | 5 | 25 | Done | 5 | 100 | 95 | 62 | F + M/γ | 1 | 230 | 467 | 49 | 55 | 33.2 | 15504 | 0 | 0.30 | Com-parative example |
| 56 | AI | 40 | 540 | 780 | 5 | 25 | Done | 4 | 100 | 96 | 65 | F + M/γ | 2 | 230 | 473 | 49 | 54 | 34.0 | 16082 | 0 | 0.31 | Com-parative example |
| 57 | AJ | 40 | 540 | 780 | 5 | 25 | Done | 2 | 98 | 98 | 70 | F + M + B | 0 | 260 | 430 | 60 | 50 | 37.2 | 15996 | 0.8 | 0.32 | Com-parative example |
| 58 | AK | 40 | 540 | 780 | 5 | 25 | Done | 5 | 95 | 95 | 70 | F + M/γ + B | 2 | 254 | 452 | 56 | 50 | 34.7 | 15684 | 0.7 | 0.31 | Com-parative example |
| 59 | AL | 30 | 540 | 770 | 5 | 25 | Done | 4 | 65 | 96 | 70 | F + M/γ + P + B | 1 | 252 | 441 | 57 | 52 | 33.7 | 14862 | 0.7 | 0.31 | Com-parative example |
| 60 | AM | 35 | 540 | 780 | 5 | 25 | Done | 4 | 98 | 96 | 72 | F + M/γ + B | 2 | 210 | 460 | 46 | 54 | 37.2 | 17112 | 0 | 0.32 | Present invention example |
| 61 | AN | 35 | 540 | 780 | 5 | 25 | Done | 7 | 97 | 93 | 74 | F + M/γ + B | 3 | 229 | 501 | 46 | 57 | 34.7 | 17385 | 0 | 0.31 | Present invention example |
| 62 | AO | 25 | 540 | 770 | 5 | 25 | Done | 4 | 95 | 96 | 78 | F + M/γ + B | 2 | 214 | 458 | 47 | 60 | 36.1 | 16534 | 0 | 0.31 | Present invention example |

F: Ferrite,
M/γ: Martensite or a small amount of retained γ,
P: Perlite,
B: Bainite Compared with former Cr-added steel, the steel sheets of the invention have a remarkably reduced weight loss due to corrosion. Compared with a steel to which a large amount of Mn is added or a steel to which Mo is added, the steel sheets of the invention have a low YP and a high BH in steel having the same TS level. More specifically, the former steels AF and AG containing a large amount of Cr have a weight loss due to corrosion as large as 0.45 to 0.75 mm. In contrast, the weight loss due to corrosion of the steel of the invention is 0.25 to 0.37 mm, and is sharply reduced. Although not shown in Tables above, when the corrosion-resistant evaluation was performed also in the former 340BH (0.002% C-0.01% Si-0.4% Mn-0.05% P-0.008% S-0.04% Cr-0.06% sol.Al-0.0018% N-0.0008% steel), the weight loss due to corrosion was 0.32 to 0.37 mm. Thus, it is found that the steel of the invention has corrosion resistance almost equivalent to the former steel. In particular, the steel E or the steel I having a low Cr amount and containing a large amount of P, the steel R in which Cu and Ni are compositely added in addition to the reduction in the Cr and the addition of a large amount of P, the steel V containing Ca, and the like have excellent corrosion resistance.

Thus, in the steels in which the Mn equivalent is controlled and the addition of a large amount of Mn is suppressed to control 8P+150B* in a given range while reducing Cr and increasing corrosion resistance, the generation of pearlite or bainite is suppressed, the ratio of the area ratio of the second phase present at the grain boundary triple point is high, and a high BH is obtained while maintaining a low YP. For example, the steels A, B, C, D, and E all achieve a high BH of 55 MPa or more while maintaining a low YP of 220 MPa or lower. In particular, in the steels A, B, C, D, and E, 8P+150B* increases while suppressing the addition amount of Mn in this order, the ratio of the second phase present at the grain boundary triple point to the second phases area ratio increases, and the BH notably increases while maintaining a low YP. It has been found that such properties are obtained in the steels to which 0.015% or more of P and 0.0003% or more of B are added rather than the steels F and H. The steels C, I, and J show that a low YP is obtained at [Mneq]≥2.2, a lower YP is obtained at [Mneq]≥2.3, and a much lower YP is obtained at [Mneq]≥2.4.

In these steels, by setting the cooling rate after hot rolling to 20° C./sec or more and more preferably 70° C./sec or more, the ratio of the second phase present at the grain boundary triple point to the second phases area ratio increases and the BH further increases. When the annealing temperature, the primary cooling rate, and the secondary cooling rate are in a given range, the ingredient steel having the components in the range of the present invention achieve a given microstructure and a favorable material quality.

The steels K, L, M, and N in which the C amount is increased in order have a low YP and a high BH in the same strength level compared with former steel in which Mn or 8P+150B* is not controlled.

The steels of the invention in which the second phase fraction is controlled in a given range and the fraction of pearlite or bainite is reduced show 0.3% or lower of YPEl after holding the same at 50° C. for three months and are all excellent in anti-aging properties.

The steels of the invention in which the second phase area ratio, the ratio of the total area ratio of the martensite and the retained γ to the second phase, and the dispersion manner of the second phase are controlled also have a high El.

In contrast, the steels X and Y in which 8P+150B* is not optimized has a high YP and a low BH. In the steel AC in which P is excessively added, the BH is high but the YP is high. The steel AH in which a large amount of Mo is added has a high YP. The steels AI, AJ, AK, and AL in which Ti, C, N, and [Mneq] are not optimized all have a high YP. In the steels AJ, AK, and AL, the anti-aging properties are also insufficient.

The invention can provide a high strength galvanized steel sheet having excellent corrosion resistance, a low YP, a high BH, and excellent anti-aging properties at low cost. Since the high strength galvanized steel sheet of the invention has excellent corrosion resistance, excellent surface distortion resistance, excellent dent resistance, and excellent anti-aging properties, an increase in the strength and a reduction in the thickness of automotive parts can be achieved.

What is claimed:

1. A method for manufacturing a galvanized steel sheet, comprising hot rolling and cold rolling a steel slab to form a steel sheet, annealing the steel sheet at an annealing temperature of higher than 740° C. and lower than 840° C. in a continuous galvanizing and galvannealing line (CGL), cooling the steel sheet at an average cooling rate of 2 to 30° C./sec from the annealing temperature to immersion in a galvanizing bath, immersing the steel sheet in the galvanizing bath for galvanization, and cooling the steel sheet to 100° C. or lower at an average cooling rate of 5 to 100° C./sec after galvanization or further performing alloying treatment of plating after galvanization, and cooling the same to 100° C. or lower at an average cooling rate of 5 to 100° C./sec after the alloying treatment;

maintaining 2.2≤[Mneq]≤3.1 and 0.42≤8[% P]+150B*≤0.73;

maintaining ferrite and a second phase as a microstructure of the steel, the second phase area ratio being 3 to 15%, and the ratio of the area ratio of martensite and retained γ to the second phase area ratio being more than 70%, with 50% or more of the area ratio of the second phase existing in the grain boundary triple point; and maintaining [Mneq]=[% Mn]+1.3[% Cr]+8[% P]+150B* and B*=[% B]+[% Ti]/48×10.8×0.9+[% Al]/27×10.8×0.025, wherein [% Mn], [% Cr], [% P], [% B], [% Ti], and [% Al] represent the content of each of Mn, Cr, P, B, Ti, and sol.Al, respectively, and in the case of B*≥0.0022, B*=0.0022 being established.

2. The method for manufacturing a galvanized steel sheet according to claim 1, wherein the steel slab is cooled to 640° C. or lower after hot-rolling at an average cooling rate of 20° C./sec or more, and then coiled at 400 to 620° C.

3. A method for manufacturing a galvanized steel sheet, comprising:

hot rolling and cold rolling a steel slab having, as an ingredient composition of the steel, C: more than 0.015% and lower than 0.100%, Si: 0.3% or lower, Mn: lower than 1.90%, P: 0.015% or more and 0.05% or lower, S: 0.03% or lower, sol.Al: 0.01% or more and 0.5% or lower, N: 0.005% or lower, Cr: lower than 0.30%, B: 0.0003% or more and 0.005% or lower, and Ti: lower than 0.014% in terms of mass %, with the balance being iron and inevitable impurities;

maintaining 2.2≤[Mneq]≤3.1 and 0.42≤8[% P]+150B*≤0.73;

maintaining ferrite and a second phase as a microstructure of the steel, the second phase area ratio being 3 to 15%, and the ratio of the area ratio of martensite and retained γ to the second phase area ratio being more than 70%, with 50% or more of the area ratio of the second phase existing in the grain boundary triple point; and maintaining [Mneq]=[% Mn]+1.3[% Cr]+8[% P]+150B* and B*=[% B]+[% Ti]/48×10.8×0.9+[% Al]/27×10.8×

0.025, wherein [% Mn], [% Cr], [% P], [% B], [% Ti], and [% Al] represent the content of each of Mn, Cr, P, B, Ti, and sol.Al, respectively, and in the case of $B^* \geq 0.0022$, $B^* = 0.0022$ being established.

* * * * *